US008875808B2

(12) United States Patent
Cherry et al.

(10) Patent No.: US 8,875,808 B2
(45) Date of Patent: Nov. 4, 2014

(54) METHOD AND ASSEMBLY FOR CONVEYING WELL LOGGING TOOLS

(75) Inventors: Ronald Eugene Cherry, Humble, TX (US); Andrew Albert Hrametz, Rosenberg, TX (US); Nathan James Harder, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/240,522

(22) PCT Filed: Jun. 28, 2012

(86) PCT No.: PCT/US2012/044540

§ 371 (c)(1), (2), (4) Date: Feb. 24, 2014

(87) PCT Pub. No.: WO2013/133860

PCT Pub. Date: Sep. 12, 2013

(65) Prior Publication Data

US 2014/0216731 A1 Aug. 7, 2014

Related U.S. Application Data

(60) Provisional application No. 61/608,970, filed on Mar. 9, 2012.

(51) Int. Cl.

| | |
|---|---|
| ***E21B 47/01*** | (2012.01) |
| ***E21B 23/14*** | (2006.01) |
| ***E21B 23/08*** | (2006.01) |
| ***E21B 47/06*** | (2012.01) |
| ***E21B 47/12*** | (2012.01) |

(52) U.S. Cl.

CPC ..... *E21B 23/08* (2013.01); *E21B 23/14* (2013.01); *E21B 47/06* (2013.01); *E21B 47/01* (2013.01); *E21B 47/12* (2013.01)

USPC ..... 175/40; 175/50; 166/254.2

(58) Field of Classification Search

CPC ..... E21B 41/01; E21B 47/12; E21B 47/16

USPC ..... 175/40, 45, 50; 166/254.2, 255.1

See application file for complete search history.

(56) References Cited

U.S. PATENT DOCUMENTS

| | | | |
|---|---|---|---|
| 3,378,069 | A | 4/1968 | Fields |
| 4,041,780 | A | 8/1977 | Angehrn |

(Continued)

FOREIGN PATENT DOCUMENTS

| | | | |
|---|---|---|---|
| FR | 2910048 | A1 | 6/2008 |
| FR | 2910049 | A1 | 6/2008 |

(Continued)

OTHER PUBLICATIONS

Authorized Officer Lee, Jong Kyung, International Search Report and Written Opinion in International Application No. PCT/US2013/037413, Jan. 20, 2014, 16 pages.

(Continued)

*Primary Examiner* — William P Neuder

(74) *Attorney, Agent, or Firm* — Anthony Iannitelli; Fish & Richardson P.C.

(57) ABSTRACT

A method for conveying logging tools (LT) and obtaining well log data from a wellbore is disclosed. The method includes running a drill string (DS) including a landing sub (LS) disposed near the lower end into a wellbore. A logging tool string (LTS) is inserted into the upper end of the DS bore. A fluid is pumped into the upper end of the DS bore to assist movement of the LTS. As the fluid is pumped behind the LTS, the cable at the surface is spooled out and the fluid pressure is monitored. The landing assembly of the LTS is landed in the LS. A diagnostic test is activated and run to determine proper functioning of the LT. A release mechanism releases the running tool portion of the LTS. The cable is spooled in. The drill pipe string is pulled upward in the wellbore as the LT are recording data.

42 Claims, 19 Drawing Sheets

(56) References Cited

U.S. PATENT DOCUMENTS

| | | | | |
|---|---|---|---|---|
| 4,349,072 | A | 9/1982 | Escaron et al. | |
| 4,485,870 | A | 12/1984 | Walulik | |
| 4,597,440 | A | 7/1986 | Pottier | |
| 4,664,189 | A | 5/1987 | Wittrisch | |
| 4,715,446 | A | 12/1987 | Wittrisch | |
| 4,729,429 | A | 3/1988 | Wittrisch | |
| 4,783,995 | A | 11/1988 | Michel et al. | |
| 4,790,380 | A | 12/1988 | Ireland et al. | |
| 4,807,717 | A | 2/1989 | Winters et al. | |
| 5,111,880 | A | 5/1992 | Wittrisch et al. | |
| 5,217,075 | A | 6/1993 | Wittrisch | |
| 6,119,777 | A | 9/2000 | Runia | |
| 6,419,013 | B1 | 7/2002 | Milne et al. | |
| 6,488,085 | B1 | 12/2002 | Milne et al. | |
| 6,578,631 | B2 | 6/2003 | Milne et al. | |
| 6,755,257 | B2 | 6/2004 | Spencer et al. | |
| 6,843,317 | B2 | 1/2005 | Mackenzie | |
| 7,188,672 | B2 | 3/2007 | Berkheimer et al. | |
| 7,201,231 | B2 | 4/2007 | Chaplin et al. | |
| 7,363,967 | B2 | 4/2008 | Burris, II et al. | |
| 7,537,061 | B2 | 5/2009 | Hall et al. | |
| 7,661,475 | B2 * | 2/2010 | Sheiretov et al. | 166/254.2 |
| 7,905,282 | B2 | 3/2011 | Bissonnette et al. | |
| 8,022,838 | B2 | 9/2011 | Murphy | |
| 8,689,867 | B2 * | 4/2014 | MacDougall et al. | 166/254.2 |
| 2002/0117300 | A1 | 8/2002 | Spencer et al. | |
| 2005/0167098 | A1 | 8/2005 | Lovell et al. | |
| 2006/0118298 | A1 | 6/2006 | Millar et al. | |
| 2007/0284116 | A1 | 12/2007 | Hall et al. | |
| 2008/0202767 | A1 | 8/2008 | Sheiretov et al. | |
| 2009/0045975 | A1 | 2/2009 | Evans et al. | |
| 2009/0194271 | A1 | 8/2009 | Bissonnette et al. | |
| 2010/0089567 | A1 | 4/2010 | Constantinou et al. | |
| 2011/0083845 | A1 | 4/2011 | McLaughlin | |
| 2011/0308797 | A1 | 12/2011 | Umphries et al. | |

FOREIGN PATENT DOCUMENTS

| | | | |
|---|---|---|---|
| GB | 2344123 | A | 5/2000 |
| WO | WO 00/17488 | | 3/2000 |
| WO | WO 02/073003 | A1 | 9/2002 |
| WO | WO 2013/133860 | | 9/2013 |
| WO | WO 2013/133861 | | 9/2013 |
| WO | WO 2013/133890 | | 9/2013 |

OTHER PUBLICATIONS

Authorized Officer Ott, Stephane, International Search Report and Written Opinion in International Application No. PCT/US2012/071986, Jan. 8, 2014, 15 pages.

Authorized Officer Ott, Stephane, International Search Report and Written Opinion in International Application No. PCT/US2012/044540, Issued by European Patent Office, mailed, Nov. 11, 2013, 11 pages.

Authorized Officer Ott, Stephane, International Search Report and Written Opinion in International Application No. PCT/US2012/044544, Issued by European Patent Office, mailed, Nov. 11, 2013, 12 pages.

Authorized Officer Schouten, Adri, International Search Report and Written Opinion in International Application No. PCT/US2012/071624, Issued by European Patent Office, mailed Oct. 9, 2013, 11 pages.

Runia et al., "Through Bit Logging: A New Method to Acquire Log Data, and a First Step on the Road to Through Bore Drilling" SPWLA 45$^{th}$ Annual Logging Symposium, Jun. 6-9, 2004, 8 pages.

Runia et al., "Through Bit Logging: Applications in Difficult Wells, Offshore North Sea" SPE/IADC 92256, Feb. 23-25, 2005, 8 pages.

* cited by examiner 200
210
211
213
215
220
217
221
222
231
233
A

B

243

251

METHOD AND ASSEMBLY FOR CONVEYING WELL LOGGING TOOLS

CROSS-REFERENCE TO RELATED APPLICATION

This is a U.S. National Phase Application under 35 U.S.C. §371 of International Patent Application No. PCT/US2012/044540, filed Jun. 28, 2012, and claims the priority of U.S. patent application Ser. No. 61/608,970 entitled "Method and Assembly for Conveying Well Logging Tools," filed on Mar. 9, 2012, both of which are incorporated by reference herein in their entirety. The International Application was published in English on Sep. 12, 2013 as WO 2013/133860 under PCT Article 21(2).

This disclosure relates to a method and assembly for conveying logging tools in a wellbore and a method for communicating with logging tools in a wellbore.

BACKGROUND

In oil and gas exploration it is important to obtain diagnostic evaluation logs of geological formations penetrated by a wellbore drilled for the purpose of extracting oil and gas products from a subterranean reservoir. Diagnostic evaluation well logs are generated by data obtained by diagnostic tools (referred to in the industry as logging tools) that are lowered into the wellbore and passed across geologic formations that may contain hydrocarbon substances. Examples of well logs and logging tools are known in the art. Examples of such diagnostic well logs include Neutron logs, Gamma Ray logs, Resistivity logs and Acoustic logs. Logging tools frequently are used for log data acquisition in a wellbore by logging in an upward (up hole) direction, from a bottom portion of the wellbore to an upper portion of the well bore. The logging tools, therefore, need first be conveyed to the bottom portion of the wellbore. In many instances, wellbores can be highly deviated, or can include a substantially horizontal section. Such wellbores make downward movement of the logging tools in the wellbore difficult, as gravitational force becomes insufficient to convey the logging tools downhole.

SUMMARY

The present disclosure relates to a method and assembly for conveying logging tools in a wellbore and a method for communicating with such logging tools when they are located in the wellbore.

In a general aspect, a method, assembly and system for conveying logging tools and obtaining well log data from a wellbore can include operation steps and components as follows. The method can include running a drill string into a wellbore to a predetermined position. The drill string has a longitudinal bore and includes a landing sub disposed proximal to the lower end of the drill string. A logging tool string can then be inserted into an upper end of the bore of the drill string. The logging tool string can include a running tool attached to a cable, a landing assembly, and one or more logging tools and a memory device. A fluid is then pumped into the upper end of the drill string bore above the logging tool string to assist movement of the logging tool string down the bore of the drill string, via fluid pressure on the logging tool string. As the fluid is pumped behind the tool string and the tool string is moving down the longitudinal bore of the drill string, the cable at the surface is spooled out. The pump pressure is observed at the surface during the fluid pump process.

The landing assembly of the logging tool string is then landed in the landing sub of the drill string. At least a portion of the tool string is disposed below the end of the drill string, including the one or more logging tools. The pump pressure can be observed at the surface when the tool string is landed in the landing sub. One or more devices in the tool string can determine that the logging tool string is landed in the landing sub. The devices can send one or more signals to a diagnostic module disposed in the logging tool string. A diagnostic test of the one or more logging tools can then be activated and run by the diagnostic module located in the logging tool string to determine proper functioning of the one or more logging tools. The diagnostic module can send instructions to a release mechanism located in the logging tool string to release the running tool portion of the tool string. A decrease in the pump pressure can be observed at the surface, indicative of release of the running tool portion from a remaining portion of the logging tool string. Then the cable is spooled in and the released running tool is retrieved. Finally the drill pipe string is pulled upward in the wellbore as the one or more logging tools are recording data in the memory device as they are pulled upward along with the drill pipe string.

In one or more specific aspects, the method can further include removing the memory logging device from the tool string and processing the recorded data in a computer system at the surface. For example, the memory logging device removal can include lowering on a cable a fishing tool adapted to grasp a fishing neck on the upper end of the tool string disposed in the landing sub in the drill pipe. The tool string and drill pipe can still be in the wellbore. In some other instances, the memory logging device removal can include removing the drill pipe from the wellbore and removing the tool string from the landing sub when the drill pipe is removed from the wellbore. The method can further include activating a reed switch disposed in the tool string by positioning the reed switch in proximity to one or more magnets disposed in the landing sub of the drill. For example, the activated reed switch can send a signal to the logging tool string indicative that the logging tool string is landed in the landing sub.

In a general aspect of an assembly for obtaining well log data from a wellbore, the assembly can include a bottom hole assembly. The bottom hole assembly is adapted to be disposed on a distal end of a drill string; and the bottom hole assembly can include a landing sub, a nozzle sub, and a tool string. The landing sub can have a bore therethrough with a landing shoulder in the bore sub. The nozzle sub can have a bore therethrough. The tool string can include a landing assembly and a logging assembly. The landing assembly includes a running tool that includes a crossover tool, a nozzle member, a release assembly, and a shock sub. The crossover tool can be adapted on an upper end to connect to a cable. The nozzle member can have a profile adapted to be received in the bore of the nozzle sub. The shock sub can have an outer profile adapted to be received in the landing shoulder of the landing sub.

The logging assembly includes a battery, at least one logging tool, a memory module, a diagnostic module, and a sensing device. The logging tool can be adapted to obtain data about at least one geologic formation penetrated by the wellbore. The memory module can store the data obtained by the at least one logging tool. The diagnostic module can be adapted to run a diagnostic sequence to determine if the at least one logging tool is functioning properly and send a signal to the release assembly. The sensing device can be adapted to detect when the logging assembly is landed in the landing sub and send a signal to the diagnostic module. The signal sent by the sensing device can further include notifying the diagnostic module that the logging assembly is in proper position for logging. The diagnostic module may begin the diagnostic sequence on the at least one logging tool.

In one or more specific aspects, the logging assembly can further include a landing sleeve disposed in the bore of the landing sub wherein at least one magnet is disposed in the landing sleeve. The sensing device disposed in the tool string can include a reed switch adapted to close when the reed switch in the tool string is proximal to the magnet in the landing sleeve.

In other implementations a position sensing device can comprise a GMR sensor or a Hall sensor. In yet other implementations the position sensing device may include a proximity detector disposed in the tool string wherein the proximity detector emits a high frequency electromagnetic field and the detector further includes a threshold circuit that searches for a change in the electromagnetic filed due to a nonferrous sleeve disposed in the landing sub and sends a signal to one or more logging tools that the tool string is in a landed position. [Inventor, is this true?]

In another implementation the sensing device disposed in the tool string comprises a mechanical switch adapted to close when the switch in the tool string contacts the landing sleeve.

The bottom hole assembly can further include a deployment sub disposed on a distal end of the bottom hole assembly. The deployment sub can have a longitudinal bore therethrough. The deployment sub can be adapted to support the logging tool when the logging assembly is landing in the landing sub and the logging tool extends through the bore. The bottom hole assembly can have a reamer disposed on the lower end of the bottom hole assembly. The reamer can include a bore adapted for passage of the logging tool therethrough. In some implementations, the logging tool can be configured to extend below the distal end of the bottom hole assembly when the logging tool assembly is landed in the landing sub. The nozzle can include a flow conduit that can be adapted to allow fluid flow from the bore of the drill pipe through the tool and a fluid bypass disposed in the landing sub.

The present disclosure includes a method of communication from the surface to the downhole logging tool string via up and down movements of the drill string. In this method, small movements of the drill string at the surface cause the tool to be seated and unseated at controlled intervals in order to create coded signals to the downhole tool string. These signals are sent to a processor in the tool string that has been preprogramed to recognize these command signals. It will be understood that similar signals can be created using reed switches and/or other position sensors including the sensors/switches.

In a general aspect, a method of communicating with a well logging tool disposed in a well bore comprises:

(a) running a drill pipe string having a longitudinal bore into a well bore to a predetermined position, said drill pipe string including a landing sub including a landing sleeve disposed proximal to the lower end of the drill pipe string;

(b) disposing in the longitudinal bore of the drill pipe a logging tool string comprising a landing assembly, at least one logging tools, and a position sensing device;

(c) landing the landing assembly of the logging tool string in the landing sub of the drill pipe and activating the position sensing device, wherein at least a portion of the tool string including the at least one logging tool is disposed below a distal end of the drill pipe string and at least a portion of the logging tool string is contacting the well bore wall;

(d) sending a signal to a processor in the logging tool string when the position sensing device is activated;

(e) lowering the drill string while the logging tool string is stationary and contacting the well bore wall, thereby moving the landing sleeve relative to the position sensing device and de-activating the switch;

(f) sending a signal to a processor in the logging tool string when the positing sensing device is de-activated;

(g) raising the drill string and positioning the position sensing device in contact with the sleeve thereby re-activating the switch and sending a signal to the processor;

(h) repeating the raising and lowering of the drill pipe one or more times in a predetermined time sequence thereby sending a signature signal to the processor; and (i) in the processor, matching the signature signal received by the processor to a signature signal pattern stored in the processor and sending an output signal correlating to the stored signature pattern to the at least one logging tool to perform an operation.

Exemplary operations can include: activating the at least one logging tool, deactivating the at least one logging tool; storing data gathered by the at least one logging tool in a memory module in the tool string; closing a logging tool centralizer; closing a logging tool caliper arm; and sending a signal to a diagnostic module in the tool string to begin the diagnostic sequence on the logging tool.

The details of one or more embodiments are set forth in the accompanying drawings and the description below. Other features, objects, and advantages will be apparent from the description and drawings, and from the claims.

DETAILED DESCRIPTION

The present disclosure relates to systems, assemblies, and methods for conveying logging tools in well where adverse conditions may be present to challenge downward movement of the logging tools in the wellbore. The disclosed logging tool conveying systems, assemblies, and methods can reduce risk of damage to the logging tools and increase speed and reliability of moving the logging tools into and out of wellbores. For example, certain wells can be drilled in a deviated manner or with a substantially horizontal section. In some conditions, the wells may be drilled through geologic formations that are subject to swelling or caving, or may have fluid pressures that make passage of the logging tools unsuitable for common conveyance techniques. The present disclosure overcomes these difficulties and provides several technical advances. For example, the logging tools can be conveyed with an electric wireline cable (sometimes referred to in the art as an "E-line"), or a generally smooth wire cable (sometimes referred to in the art as a "Slickline"), without communication by the logging tools to a data well log data processing unit located at the surface (sometimes referred to in the art as a "logging unit" or "logging truck"). In addition, in the present invention a surface pressure signature is created for indicating when the logging tools have been positioned downhole and are ready to begin data acquisition in the wellbore, and when other associated functions such as releasing the logging tools, retrieving the running tool or retrieving the logging tool can be initiated. In some implementations, the logging tools can include a shock sub for preventing damage during landing of the logging tool string in a landing sub disposed in the drill string located in the wellbore, a magnetic switch for sensing the position of the logging tool string in the landing sub of the drill string and signaling the logging tools to power up for obtaining data and other functionally enhancing components such as additional battery sections for extended recording time, or low power consumption tools.

Figure 1A:
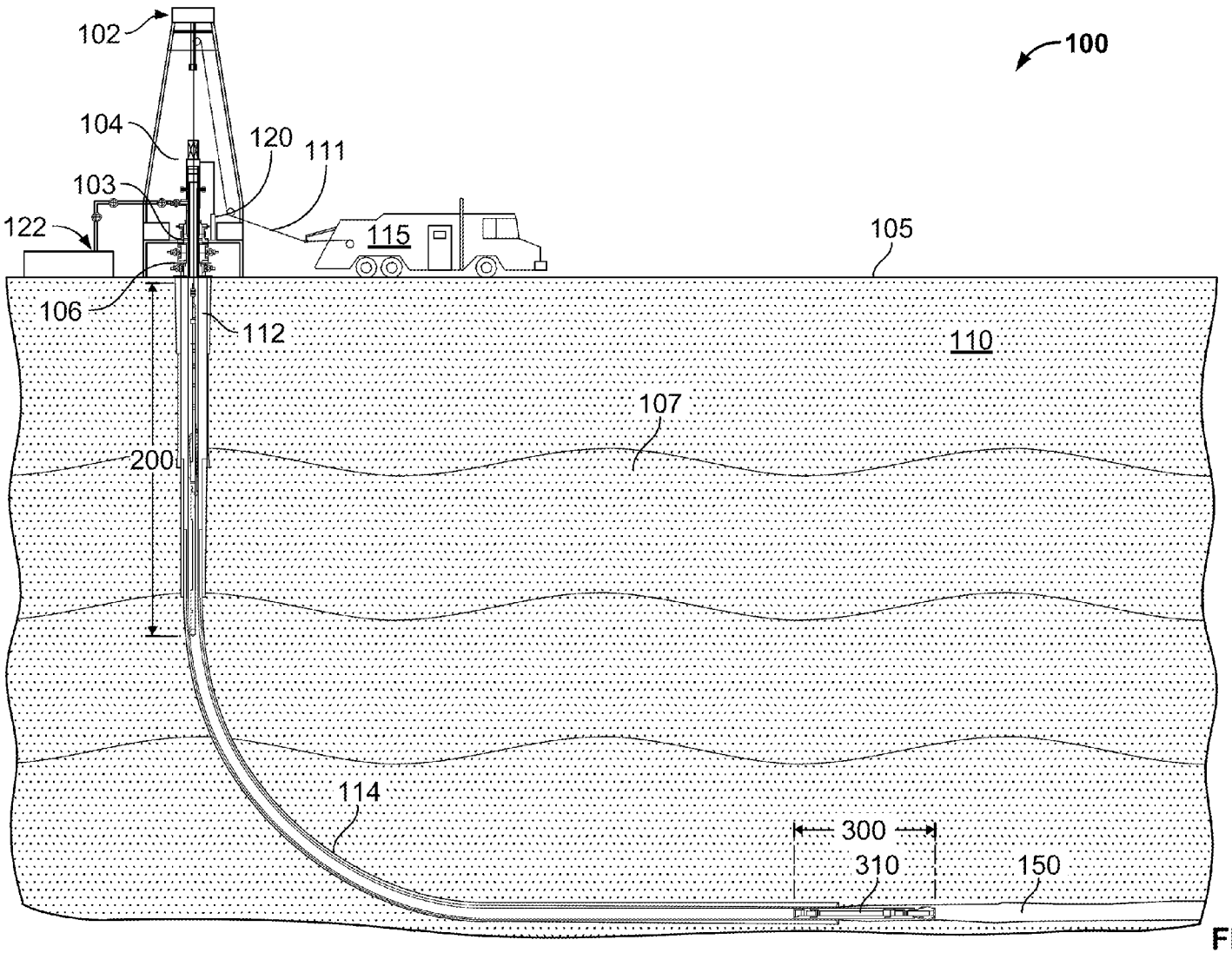
FIGS. 1A to 1E illustrate operations of a logging tool conveying system.

FIGS. 1A to 1E illustrate operations of a logging tool conveying system 100. The logging tool conveying system 100 includes surface equipment above the ground surface 105 and a well and its related equipment and instruments below the ground surface 105. In general, surface equipment provides power, material, and structural support for the operation of the logging tool conveying system 100. In the embodiment illustrated in FIG. 1A, the surface equipment includes a drilling rig 102 and associated equipment, and a data logging and control truck 115. The rig 102 may include equipment such as a rig pump 122 disposed proximal to the rig 102. The rig 102 can include equipment used when a well is being logged such as a logging tool lubrication assembly 104 and a pack off pump 120. In some implementations a blowout preventer 103 will be attached to a casing head 106 that is attached to an upper end of a well casing 112. The rig pump 122 provides pressurized drilling fluid to the rig and some of its associated equipment. The data logging and control truck 115 monitors the data logging operation and receives and stores logging data from the logging tools. Below the rig 102 is a wellbore 150 extending from the surface 105 into the earth 110 and passing through a plurality of subterranean geologic formations 107. The wellbore 150 penetrates through the formations 107 and in some implementations forms a deviated path, which may include a substantially horizontal section as illustrated in FIG. 1A. Near the surface 105, part of the wellbore 150 may be reinforced with the casing 112. A drill pipe string 114 can be lowered into the wellbore 150 by progressively adding lengths of drill pipe connected together with tool joints and extending from the rig 102 to a predetermined position in the wellbore 150. A bottom hole assembly 300 may be attached to the lower end of the drill string before lowering the drill string 114 into the well bore.

At a starting position as shown in FIG. 1A, a logging tool string 200 is inserted inside the drill pipe string 114 near the upper end of the longitudinal bore of the drill pipe string 114 near the surface 105. The logging tool string 200 may be attached with a cable 111 via a crossover tool 211. As noted above, the bottom hole assembly 300 is disposed at the lower end of the drill string 114 that has been previously lowered into the wellbore 150. The bottom hole assembly 300 may include a landing sub 310 that can engage with the logging tool string 200 once the logging tool string 200 is conveyed to the bottom hole assembly 300. The conveying process is conducted by pumping a fluid from the rig pump 122 into the upper proximal end of the drill string 114 bore above the logging tool string 200 to assist, via fluid pressure on the logging tool string 200, movement of the tool string 200 down the bore of the drill string 114. The fluid pressure above the logging tool string 200 is monitored constantly, for example, by the data logging control truck, because the fluid pressure can change during the conveying process and exhibit patterns indicating events such as landing the tool string 200 at the bottom hole assembly 300. As the tool string 200 is pumped (propelled) downwards by the fluid pressure that is pushing behind the tool string 200 down the longitudinal bore of the drill pipe string 114, the cable 111 is spooled out at the surface.

Figure 1B:
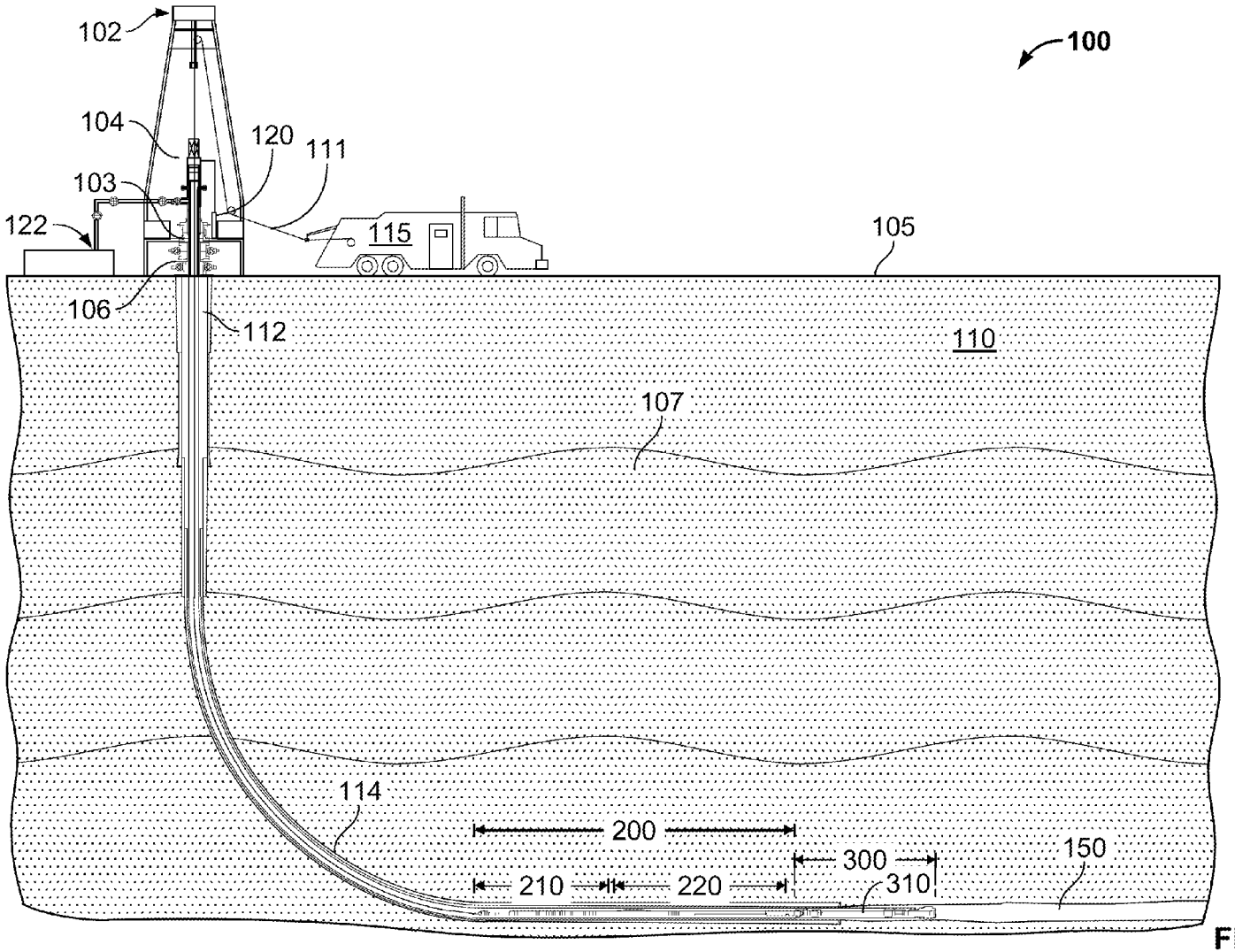
Figure 1C:
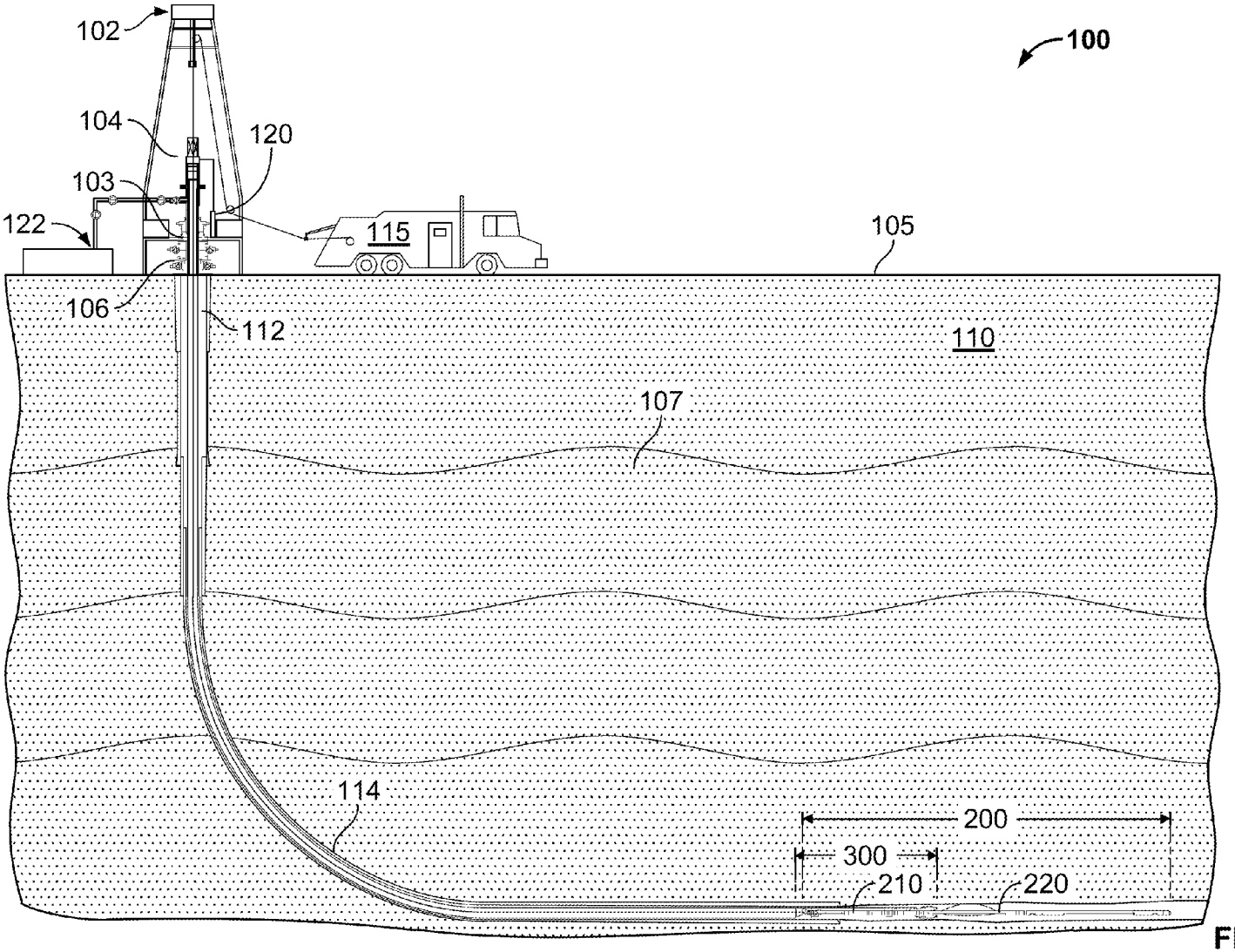

In FIG. 1B, the logging tool string 200 is approaching the bottom hole assembly 300. The tool string 200 is to be landed in the landing sub 310 disposed in the bottom hole assembly 300 which is connected to the distal lower portion of the drill pipe 114. At least a portion of the tool string 200 has logging tools that, when the tool string is landed in the bottom hole assembly 300, will be disposed below the distal end of the bottom hole assembly of the drill pipe string 114. In some implementations, the logging tool string 200 includes two portions: a landing assembly 210 and a logging assembly 220. As illustrated in FIG. 1B, the landing assembly 210 is to be engaged with the bottom hole assembly 300 and the logging assembly 220 is to be passed through the bottom hole assembly 300 and disposed below the bottom hole assembly. This enables the logging tools to have direct access to the geologic formations from which log data is to be gathered. Details about the landing assembly 210 and the logging assembly 220 are described in FIGS. 2A to 2E. As the tool string 200 approaches the bottom hole assembly 300, the rig pump 122 fluid pressure is observed at the surface 105, for example, at the data logging control truck 115.

Figure 1D:
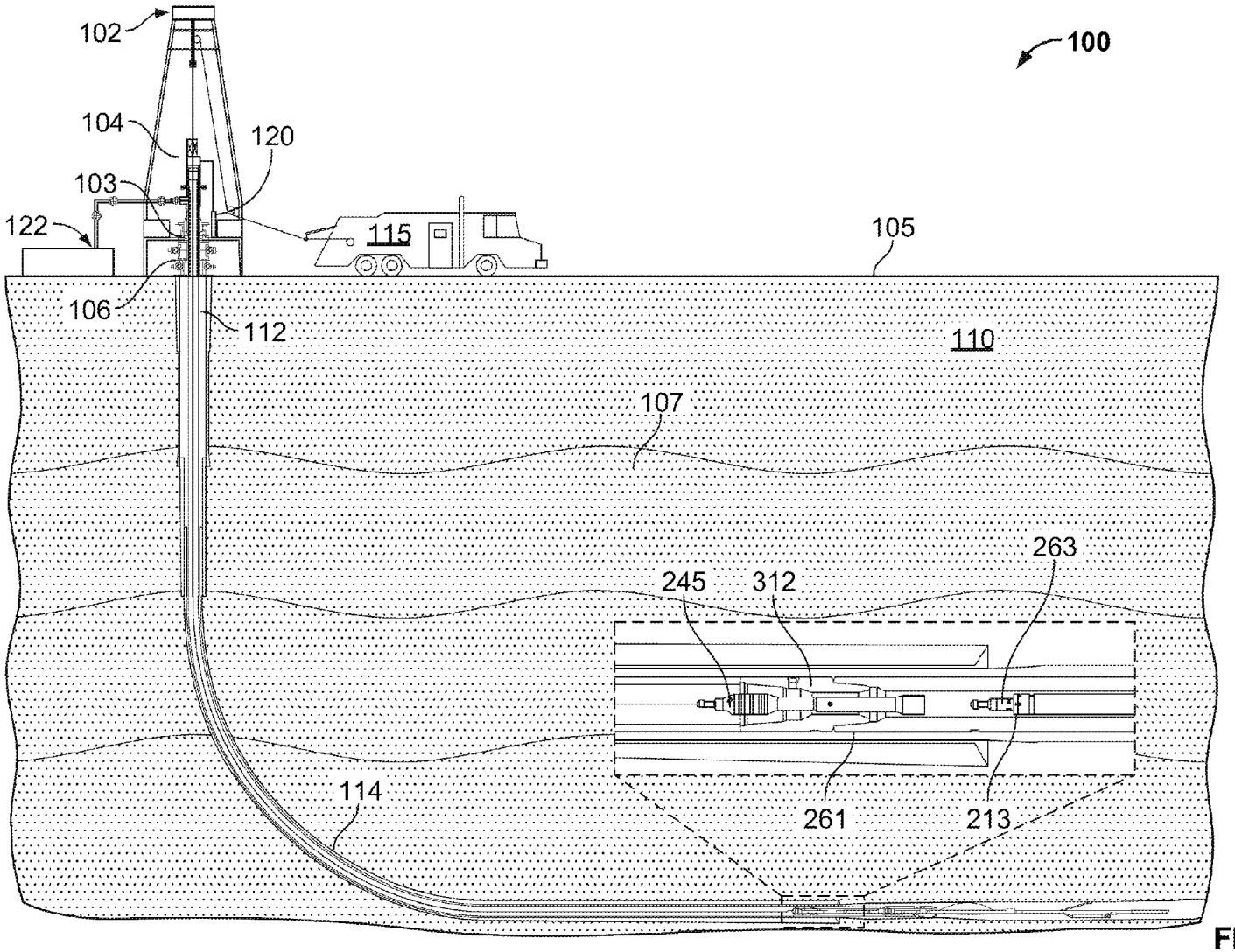
Figure 5:
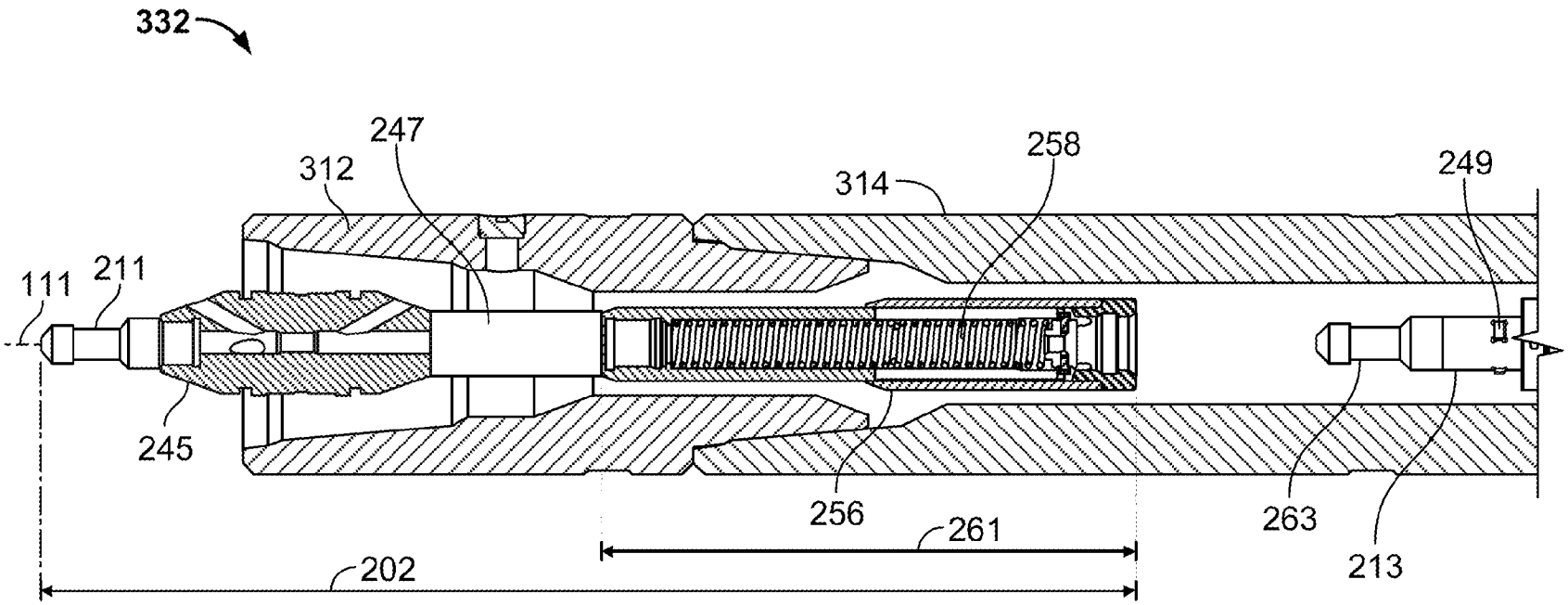
FIG. 5 is a detail half cross-section view of a portion of the logging tool string at bottom hole assembly.

A sudden increase of the fluid pressure can indicate that the tool string 200 has landed in the landing sub 310 of the bottom hole assembly 300. For example, in FIG. 1C, the logging tool string 200 has landed and engaged with landing sub 310 of the bottom hole assembly 300. The fluid pressure increases because the fluid is not able to circulate past the outside of the upper nozzle 245 when it is seated in the nozzle sub 312. A self-activating diagnostic sequence can be automatically initiated by a diagnostic module located in the logging assembly 220 to determine if the logging assembly 220 is properly functioning. Details of the self-activating mechanism are described below in FIGS. 3 and 5. Referring to FIG. 1D, when the proper functioning of the logging tool 220 is confirmed by the downhole diagnostics module, instructions are sent from the downhole diagnostics module to the downhole motor release assembly 213 to release the running tool 202 from the tool string 200 and displace the running tool 202 away from the upper end of the tool string 200. The running tool 202 includes a crossover tool 211 that connects the cable 111 to the upper nozzle 245 and the spring release assembly 261. A decrease in the pump pressure can then be observed as indicative of release and displacement of the running tool 202 from the tool string 200 which again allows fluid to freely circulate past upper nozzle 245. Once the pressure decrease has been observed at the surface, the cable 111 is spooled in by the logging truck 115. A release operation detail view 332 of the release of part of the running tool 202 is shown in FIG. 5. The release operation detail view 332 shows detachment of the spring release assembly 261 from the fishing neck 263. The motor release assembly 213 can include a motorized engagement mechanism that activates the spring release dogs 249 that are securing the running tool 202 to the fishing neck 263. The spring release assembly 261 can include a preloaded spring 258 which forcibly displaces the running tool 202 from the landing nozzle 312.

Figure 1E:
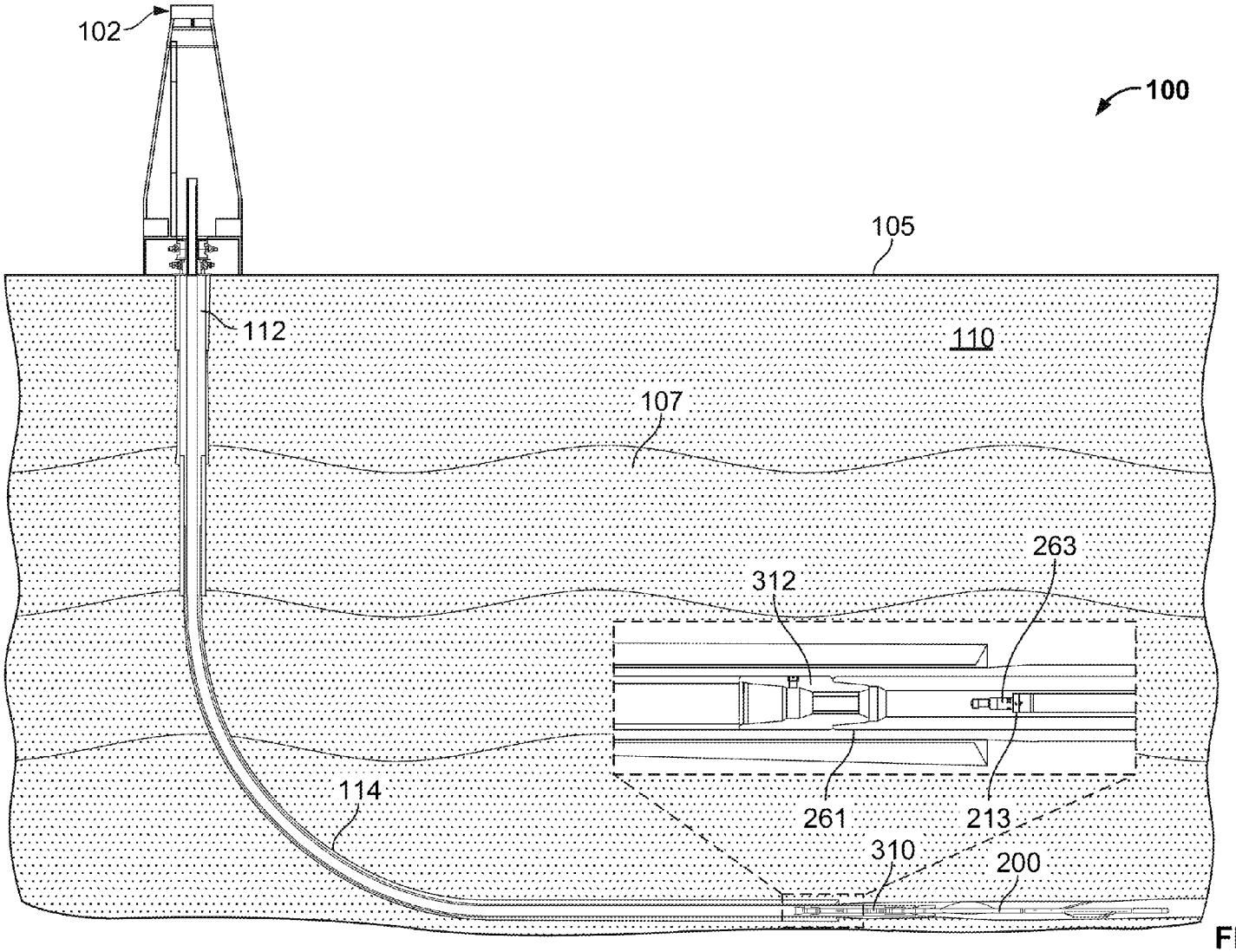

In FIG. 1E, the cable 111 and the running tool 202 have been completely retrieved and removed from drill string 114. The system 100 is ready for data logging. As discussed above, the logging assembly 220 is disposed below the lower end of the bottom hole assembly 300 and can obtain data from the geologic formations as the logging assembly 220 moves past the formations. The drill pipe string 114 is pulled upward in the wellbore 150 and as the logging tool assembly 220 moves past the geologic formations, data is recorded in a memory logging device that is part of the logging assembly 220 (shown in FIGS. 2A to 2E). The drill string is pulled upward by the rig equipment at rates conducive to the collection of quality log data. This pulling of the drill string from the well continues until the data is gathered for each successive geologic formation of interest. After data has been gathered from the uppermost geologic formations of interest, the data gathering process is completed. The remaining drill pipe and bottom hole assembly containing the logging tool string 200 is pulled from the well to the surface 105. In some implementations, the logging tool string 200 can be removed from the well to the surface 105 by lowering on a cable 111 a fishing tool adapted to grasp the fishing neck 263 while the tool string and drill pipe are still in the well bore. The tool grasps the fishing neck and then the cable is spooled in and the tool and the logging tool string are retrieved. The data contained in the memory module of the logging assembly 220 is downloaded and processed in a computer system at the surface 105. In some implementations, the computer system can be part of the data logging control truck 115. In some implementations, the computer system can be off-site and the data can be transmitted remotely to the off-site computer system for processing. Different implementations are possible. Details of the tool string 200 and the bottom hole assembly 300 are described below.

Figures 2A, 2B, 2C, 2D:
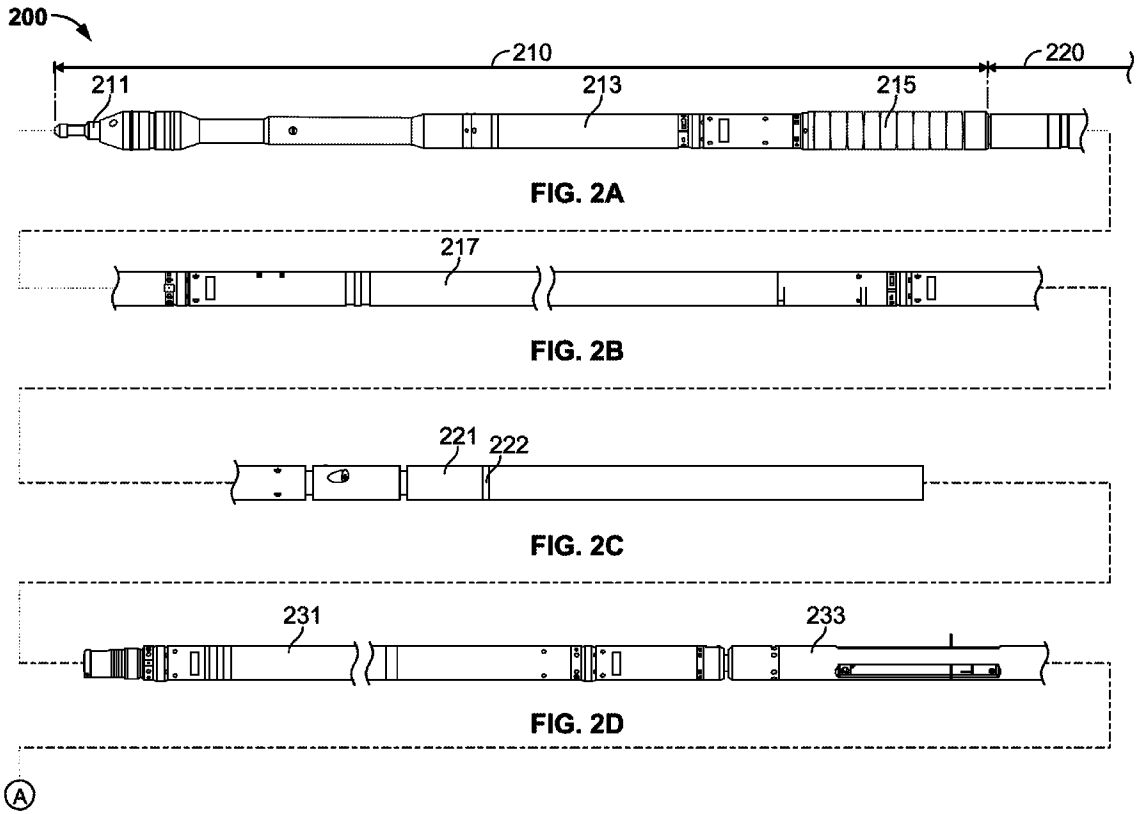
FIGS. 2A to 2K are side views of a logging tool string applicable to the operations illustrated in FIGS. 1A to 1E.

FIGS. 2A to 2K are side views of the logging tool string 200 applicable to the operations illustrated in FIGS. 1A to 1E. The logging tool string 200 includes two major sections: the landing assembly 210, and the logging assembly 220 that can be separated at a shock sub 215. Referring to FIGS. 2A and 2B, the complete section of the landing assembly 210 and a portion of the logging assembly 220 are shown. The landing assembly 210 can include the crossover tool 211, a nozzle 245, a spring release assembly 261, a motorized tool assembly 213, and the shock sub 215. The landing assembly 210 allows the logging tool string 200 to engage with the bottom hole assembly 300 without damage to onboard instruments. A running tool 202 comprises a subset of the landing assembly 210. The running tool 202 includes the crossover tool 211 and the spring release assembly 261. Retrieval of the running tool 202 will be described later herein. The logging assembly 220 includes various data logging instruments used for data acquisition; for example, a battery sub section 217, a sensor and invertor section 221, a telemetry gamma ray tool 231, a density neutron logging tool 241, a borehole sonic array logging tool 243, a compensated true resistivity tool array 251, among others. An accelerometer 222 is located in invertor section 221. In some embodiments, the accelerometer 222 is a MEMS Technology, micro-electro-mechanical-system. This electro-mechanical device is located onto a silicon chip and is part of the sensor printed circuit board located in the inverter section 221. This sensor measures movement or acceleration in the Z axis. The Z axis is in line with the up and down motion of the logging tool string, e.g. running in and out of the well.

Referring to the landing assembly 210, the running tool 202 is securely connected with the cable 111 by crossover tool 211. As the tool string 200 is propelled down the bore of the drill string by the fluid pressure, the rate at which the cable 111 is spooled out maintains movement control of the tool string 200 at a desired speed. After landing of the tool string 200, the running tool can be released by the motorized tool assembly 213. The motorized tool releasable subsection 213 includes an electric motor and a release mechanism including dogs 249 for releasing the running tool section 202 from the fishing neck disposed on the upper portion of the logging assembly 220. The electric motor can be activated by a signal from the diagnostic module in the logging assembly after the diagnostic module has confirmed that the logging assembly is operating properly. The electric motor can actuate the dogs 249 to separate the running tool 202 from the rest of the landing assembly 210.

Referring to the logging assembly 220 in FIG. 2A. The logging assembly 220 and the landing assembly 210 are separated at the shock sub 215. One major functional section behind the shock sub 215 is the battery sub section 217. The battery sub section 217 can include high capacity batteries for logging assembly 220's extended use. For example, in some implementations, the battery sub section 217 can include an array of batteries such as Lithium ion, lead acid batteries, nickel-cadmium batteries, zinc-carbon batteries, zinc chloride batteries, NIMH batteries, or other suitable batteries. In FIG. 2C, the sensor and invertor section 221 is included in the logging assembly 220. The sensor and invertor section 221 can include sensors for detecting variables used for control and monitoring purposes (e.g., accelerometers, thermal sensor, pressure transducer, proximity sensor), and an inverter for transforming power from the battery sub section 217 into proper voltage and current for data logging instruments.

Figures 2E, 2F, 2G:
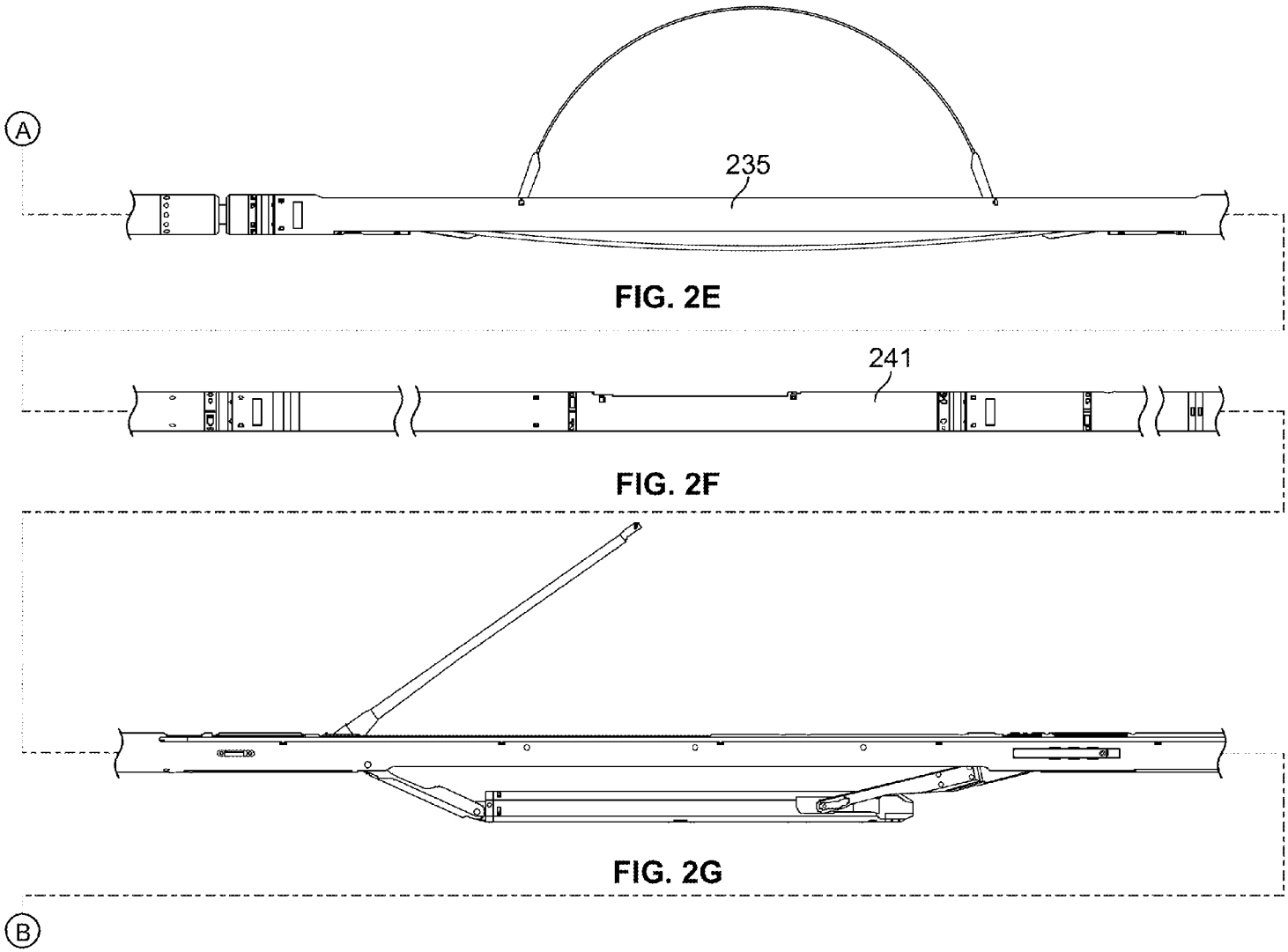

In FIGS. 2D and 2E, the logging assembly 220 further includes the telemetry gamma ray tool 231, a knuckle joint 233 and a decentralizer assembly 235. The telemetry gamma ray tool 231 can record naturally occurring gamma rays in the formations adjacent to the wellbore. This nuclear measurement can indicate the radioactive content of the formations. The knuckle joint 233 can allow angular deviation. Although the knuckle joint 233 is placed as shown in FIG. 2D. It is possible that the knuckle joint 233 can be placed at a different location, or a number of more knuckle joints can be placed at other locations of the tool string 200. In some implementations, a swivel joint (not shown) may be included below the shock sub assembly 215 to allow rotational movement of the tool string. The decentralizer assembly 235 can enable the tool string 200 to be pressed against the wellbore 150.

In FIGS. 2F to 21, the logging assembly 220 further includes the density neutron logging tool 241 and the borehole sonic array logging tool 243.

Figures 2H, 2I, 2J, 2K:
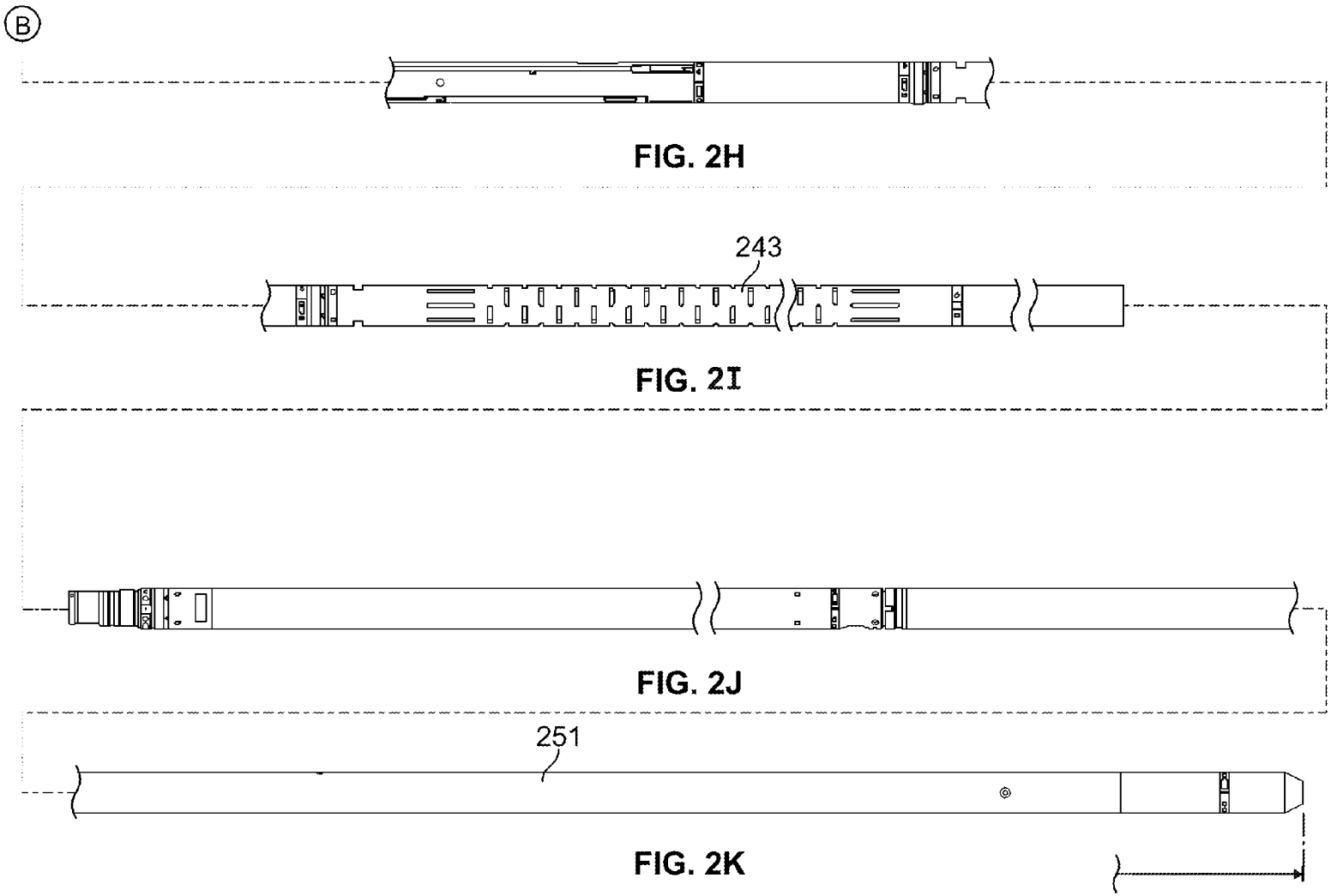

In FIGS. 2E and 2K, the logging assembly 220 further includes the compensated true resistivity tool array 251. In other possible configurations, the logging assembly 220 may include other data logging instruments besides those discussed in FIGS. 2A through 2K, or may include a subset of the presented instruments.

Figure 3A:
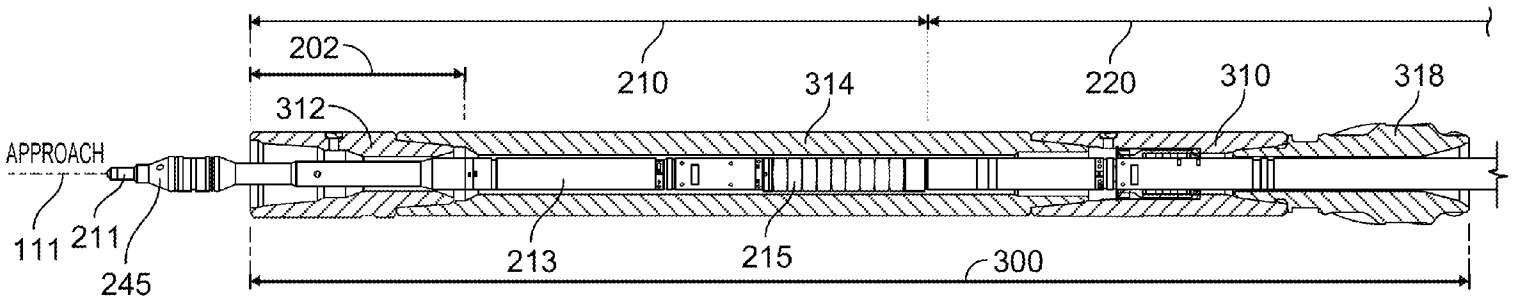
FIGS. 3A to 3C are cross-sectional side views of the logging tool string inside a bottom hole assembly during different operational phases.
Figure 3B:
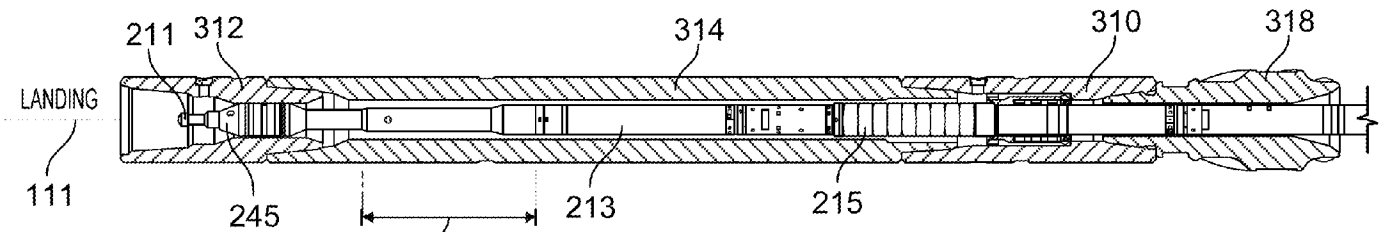
Figure 3C:
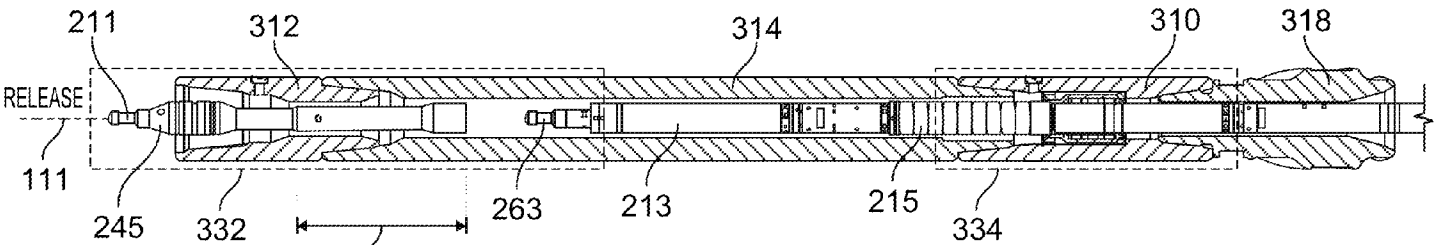

FIGS. 3A to 3C are cross-sectional side views of the logging tool string 200 inside the bottom hole assembly 300 during different operation phases. FIG. 3A shows the operation of the logging tool string 200 approaching the bottom hole assembly 300, which can correspond to the scenario shown in FIG. 1B. FIG. 3B shows the operation of the logging tool string 200 landing onto the bottom hole assembly 300, which can correspond to the scenario shown in FIG. 1C. FIG. 3C shows the operation of the logging tool string 200 releasing the running tool 202 after landing onto the bottom hole assembly 300, which can correspond to the scenario shown in FIG. 1D. FIG. 3C further illustrates two detail views: the reed switch detail view 334 and the release operation detail view 332, which are respectively illustrated in FIG. 4A and FIG. 5.

In a general aspect, referring to FIGS. 5 and 4A to 4F, the bottom hole assembly 300 can include four major sections: the nozzle sub 312, the spacer sub 314, the landing sub 310, and the deployment sub 318. The nozzle sub 312 may be configured such that the tool string 200 can be received at and guided through the nozzle sub 312 when the tool string 200 enters the bottom hole assembly 300 in FIG. 3A. The spacer sub 314 can determine the distance between the nozzle sub 312 and the landing sub 310. The landing sub 310 can include a landing sleeve 340 that receives the tool string 200 during landing. For example, the landing sub 310 can include a landing shoulder, a fluid by-pass tool, and a number of control coupling magnets for the landing operation. Details of the components and operation mechanisms are described in FIG. 4A to 4E. The deployment sub 318 can be the lowermost distal piece of the bottom hole assembly 300 constraining the logging assembly 220, which extends beyond the deployment sub 318 with data logging instruments. In some implementations the deployment sub 318 may be replaced with a modified reamer or hole opener for reaming through a tight spot in the previously drilled wellbore, each of which may be configured to have a longitudinal passage adapted to allow the passage of the logging assembly therethrough. In other implementations, the deployment sub may not be present and the landing sub may include a lower cutter or reamer that would provide the ability to ream through a tight spot in the preexisting well bore.

Referring to FIG. 3A, the tool string 200 is approaching the bottom hole assembly 300 for landing. The shock sub 215 may have an outer diameter larger than the non-compressible outer diameter of the instruments in the logging assembly 220, so that the logging assembly 220 can go through the landing sub 310 without interfering with the bottom hole assembly 300. The non-compressible outer diameter of the instruments in the logging assembly 220 fits into the inner diameter of the landing sub 310, centralization of the logging tool 220 through and immediately beyond the deployment sub 318. The shock sub 215's outer diameter is larger than the inner diameter of the landing sub 310 so that the shock sub 215 can land onto the landing sub 310. For example, at landing the shock sub 215 can impact on the landing shoulder of the landing sub 310 and cease the motion of the tool string 200, as illustrated in FIG. 3B.

Figure 4A:
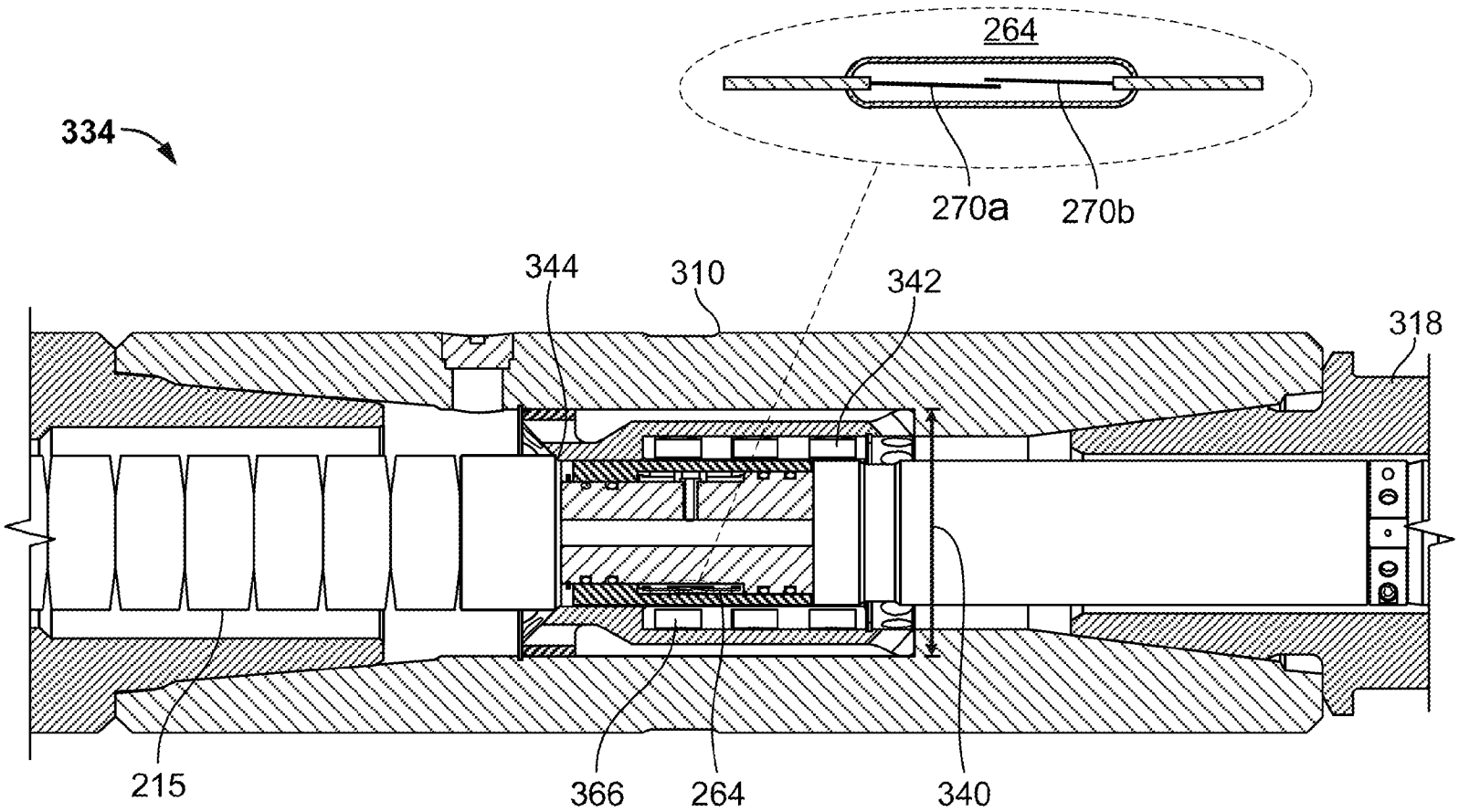
FIGS. 4A to 4E are detail half cross-sectional views of a portion of the logging tool string and the bottom hole assembly illustrating different implementations of a position sensor.
Figure 4B:
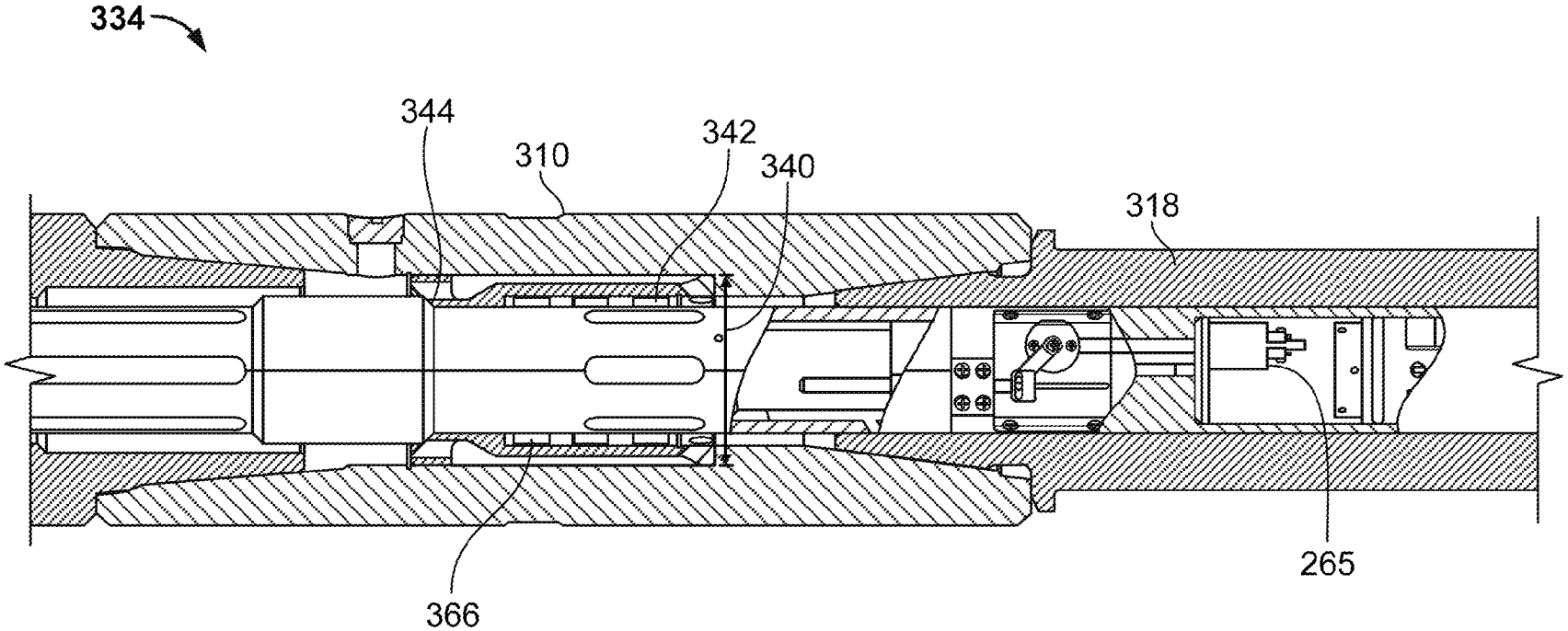

The landing process may further be illustrated in FIG. 4A, where the reed switch detail view 334 is shown. A landing sleeve 340 is centrally placed in the landing sub 310. The landing sleeve 340 has structural features such as fluid by-pass holes 342 and the landing shoulder 344. The landing shoulder 344 can be profiled to receive the shock sub 215 with an area of contact. The landing sleeve 340 houses a number of magnets 366 that can be used to actuate reed switches 264 in the tool string 200. The reed switches 264 are installed inside a reed switch housing 260 abutting the shock sub 215 in the tool string 200. The reed switches 264 can be actuated by the magnets 366 when the tool string 200 is landed. For example, the reeds 270*a* and 270*b* can be deflected to contact each other when the reed switch 264 becomes near the magnets 366. The magnets 366 can be permanent magnets or electromagnets. Once the reed switch 264 is activated by being positioned proximal to the magnets in the landing sub 310, an automated self-diagnosis can be initiated in the tool string 200 by the diagnostic module to determine when the running tool 202 can be released. In addition to activation of the reed switches, there may be other prerequisites that the downhole diagnostic module may require before allowing release of the running tool 202 such as programmed temperature and pressure thresholds, additional proximity sensors, and accelerometer feedback indicating movement of the assembly has ceased.

In FIG. 3C, after the tool string 200 is properly landed on the bottom hole assembly 300 and the reed switch 264 is activated and has been at position for at least a predetermined time period, the running tools 202 can be released from the rest of the tool string 200. The activation command requires that the reed switch remain closed for a pre-determined time period to eliminate false activations from magnetic anomalies found in the drill pipe. The release operation occurs at the motorized tool releasable subsection 213, where the spring release assembly 261 becomes disengaged from the fishing neck 263. The releasing operation can further be illustrated in FIG. 5, where the release operation detail view 332 is shown. Briefly referring to FIG. 5, the spring release assembly 261 is connected to the cable 111 through the crossover tool 211, the nozzle 245 and the extension rod 247. The nozzle 245 can seal with the nozzle sub 312 when the tool string 200 is landed to produce a distinct fluid pressure signature (see FIG. 7). The spring release assembly 261 may include a housing 256, a spring 258, and engaging dogs 249. At release in FIG. 3C, the running tool 202 is moved towards the surface 105 via reeling in the cable 111 at the logging truck 115.

It will be understood that other implementations of switches may be used instead of a reed switch. For example referring to FIG. 4B wherein is illustrate an implementation using a mechanical switch 265. The mechanical switch accomplishes the same function as all the other embodiments of sensing when the tool has landed in the landing sub and sends an on/off command to the logging tool string. The mechanical switch is triggered when a spring loaded plunger is depressed as the shock sub engages the landing sub.

Figure 4C:
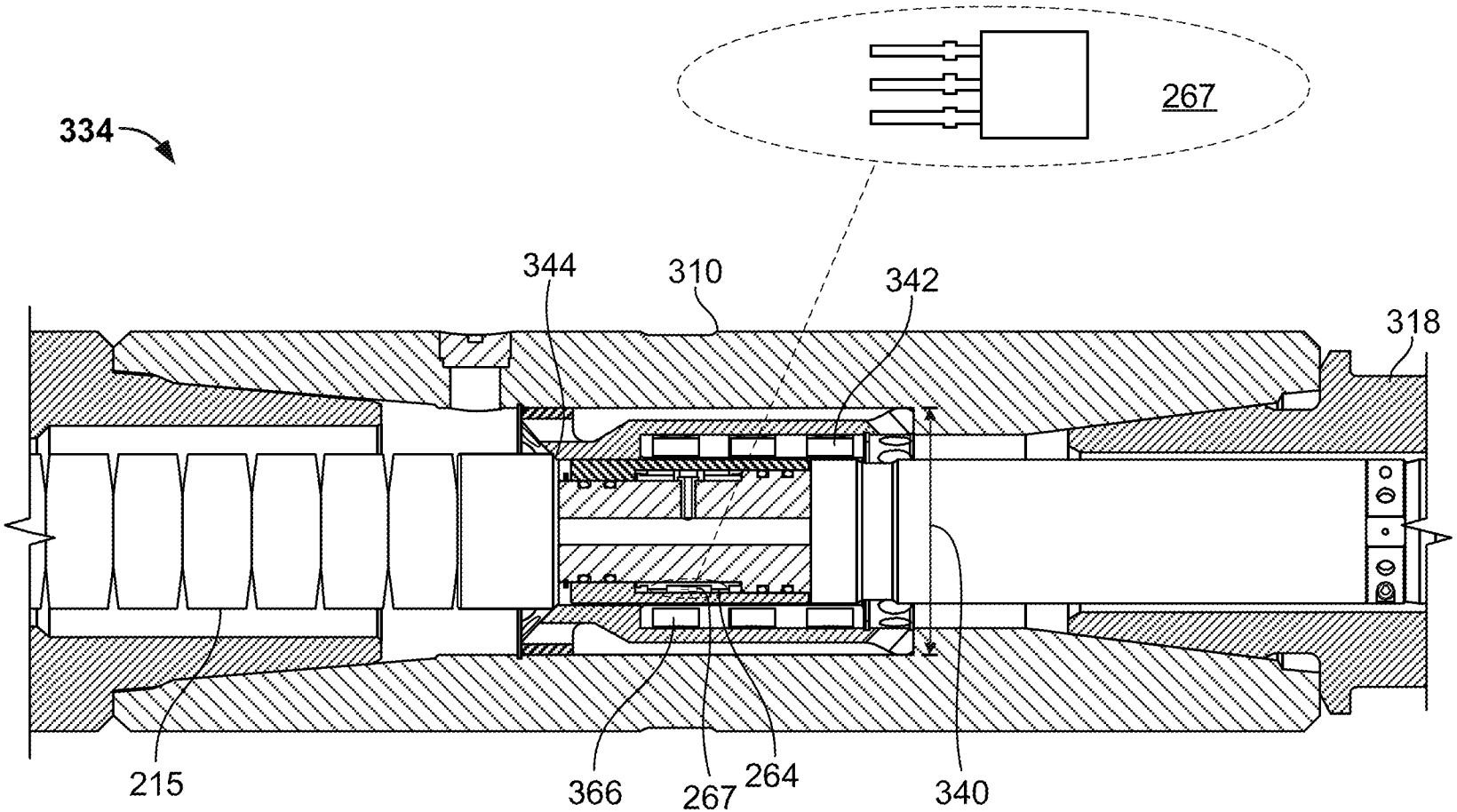

In another implementation, referring to FIG. 4C, a Hall Effect Sensor 267 is used as a switch. The hall effect sensor is an analog transducer that varies its output voltage in response to a magnetic field. Hall Effect Sensors can be combined with electronic circuitry that allows the device to act in a digital (on/off) mode i.e. a switch. In this implementation, rare earth magnets located in the landing sub trigger to hall sensor.

Figure 4D:
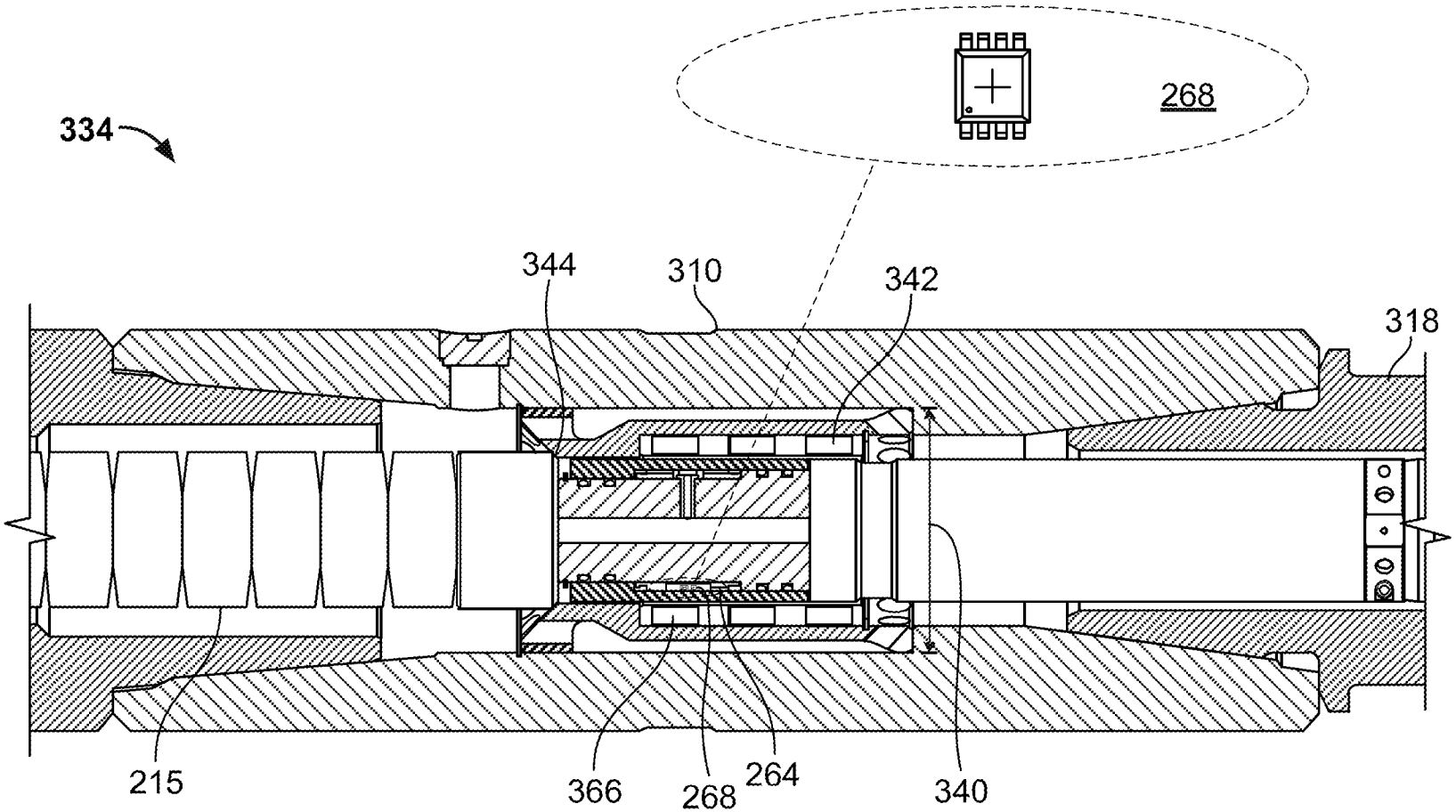

In another implementation, referring to FIG. 4D, a GMR or "Giant Magneto Restrictive" 268 is used as a switch. In some implementations a GMR is formed of thin stacked layers of ferromagnetic and non-magnetic materials which when exposed to a magnetic field produces a large change in the devices electrical resistance. The magnetic flux concentrators on the sensor die gather the magnetic flux along a reference axis and focus it at the GMR bridge resistors in the center of the die. The sensor will have the largest output signal when the magnetic field of interest is parallel to the flux concentrator axis and can be combined with electronic circuitry that allows the device to act in a digital (on/off) mode i.e. switch. The trigger for this embodiment would be rare earth magnets located in the landing sub.

Figure 4E:
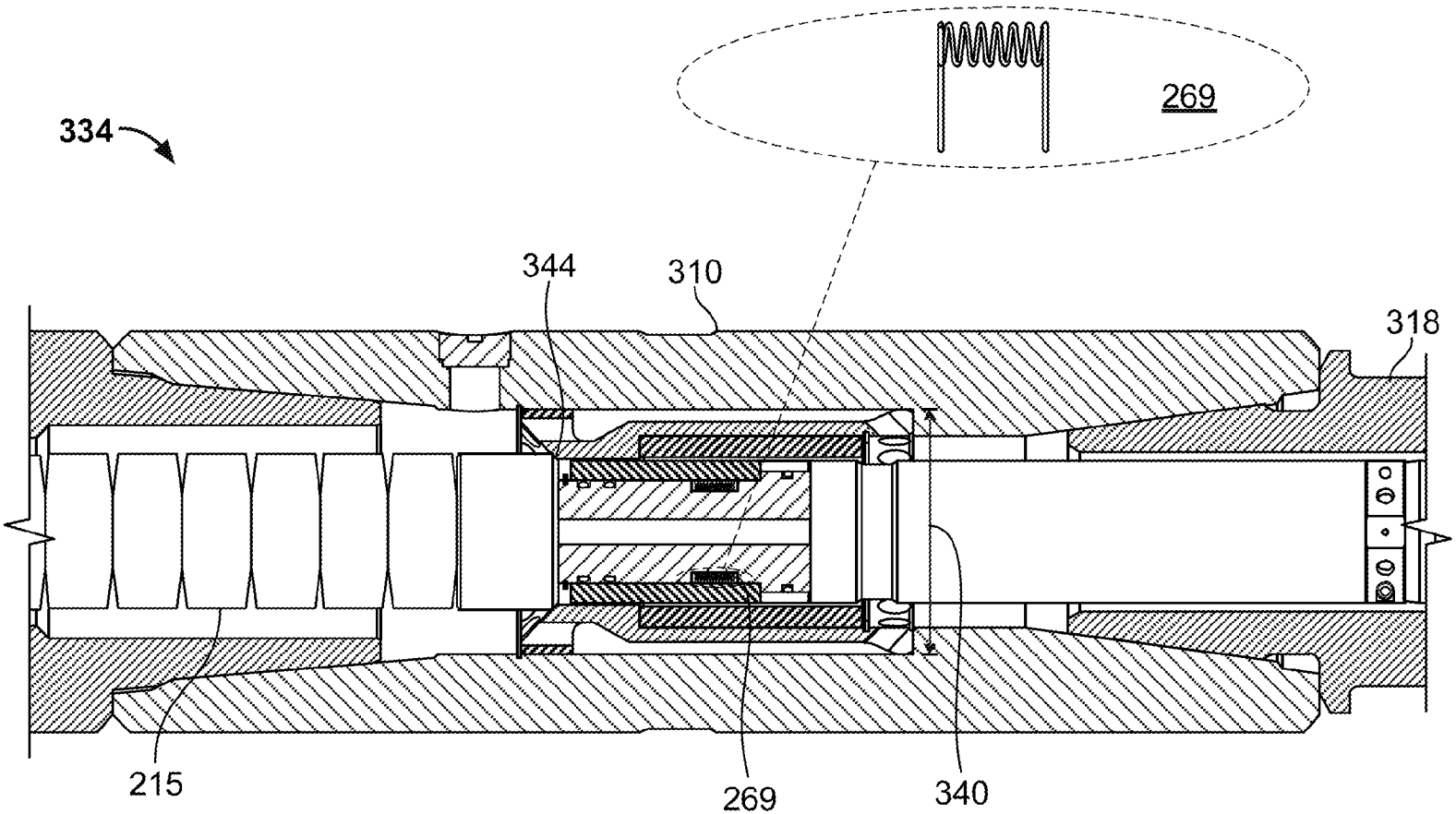

In another implementation, referring to FIG. 4E, a proximity sensor 269 is used as a switch. The proximity sensor 269 is able to detect the presence of metallic objects without any physical contact. In some implementations, a proximity detector uses a coil to emit a high frequency electromagnetic field and looks for changes in the field or return signal in the presence or absence of metal. This change is detected by a threshold circuit which acts in a digital (on/off) mode i.e. switch. The trigger for this embodiment would be a nonferrous sleeve located in the landing bypass sub. In an alternative implementation, the Proximity Detector/Mutual Inductance Sensor 269 could also be relocated in the tool string so that when the tool lands in the landing sub the sensor would be positioned just past the deployment sub and out into the open borehole a short distance past any ferrous metals. The sensor would interpret this as being in the presence of metal and the absence of metal acting as an on/off switch.

Figure 6A:
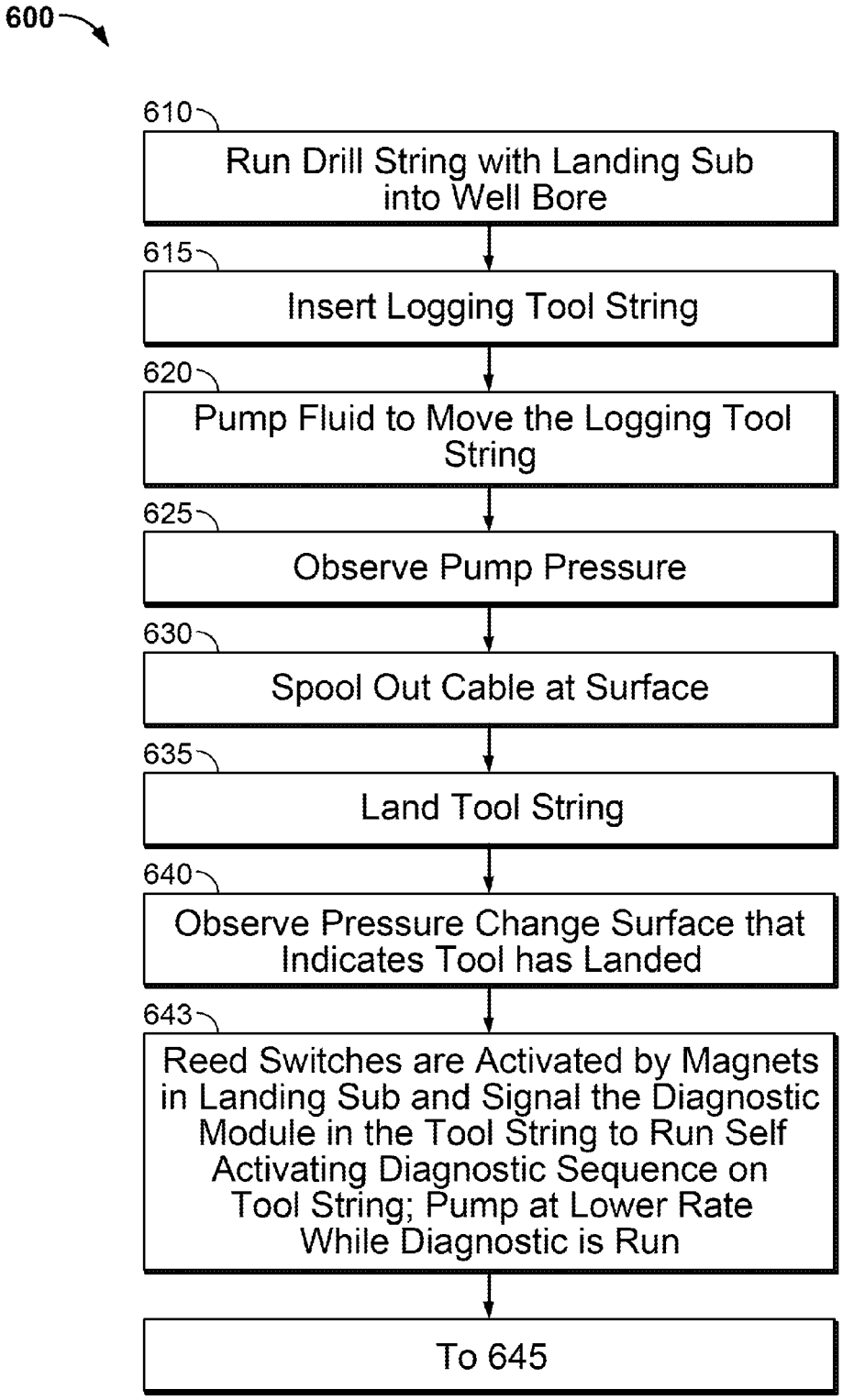
FIGS. 6A and 6B are a flow chart illustrating the operations of landing the logging tool in the bottom hole assembly.
Figure 6B:
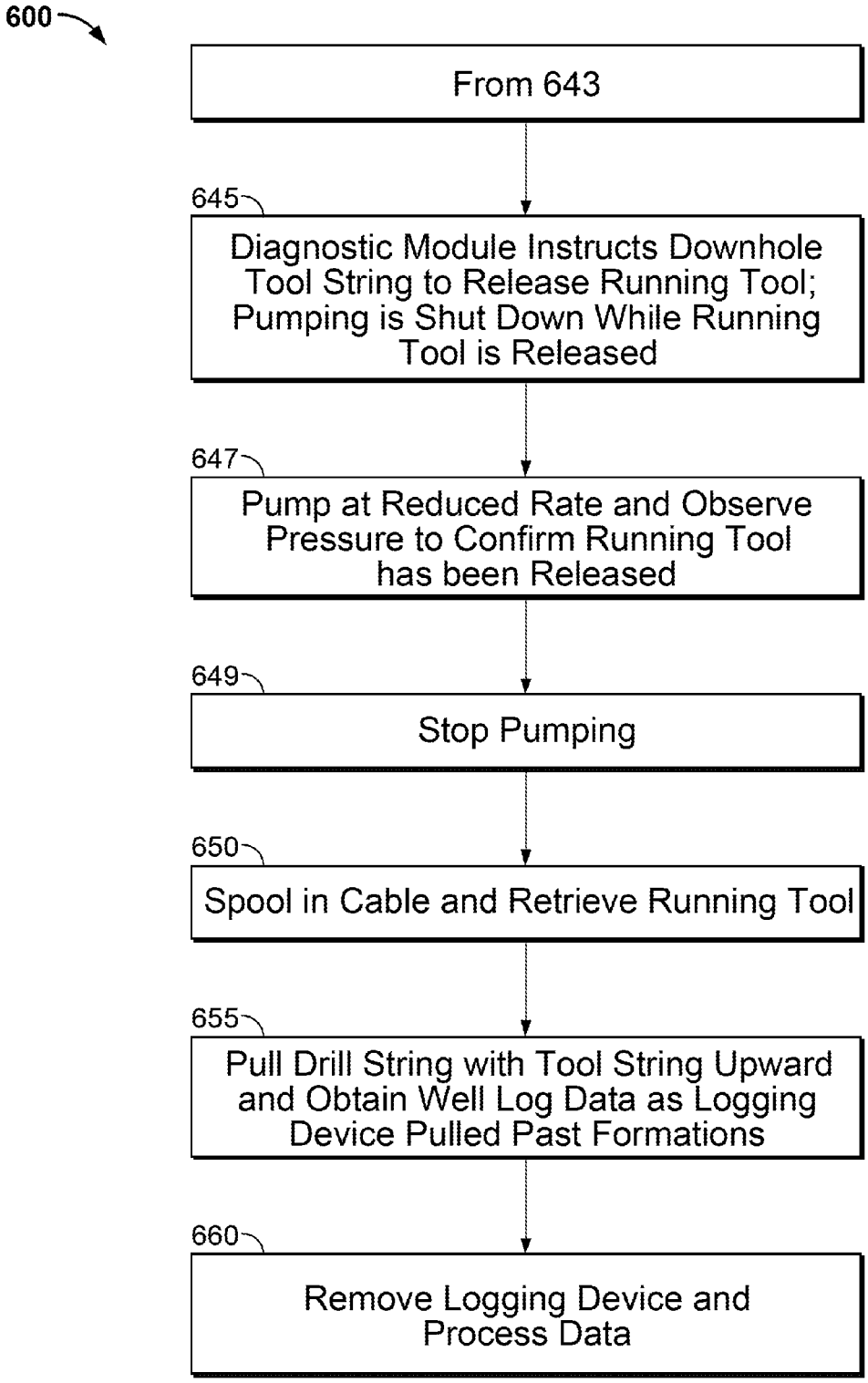

FIG. 6 is a flow chart 600 illustrating the operations of landing the logging tool 200 in the bottom hole assembly 300. At 610, a drill pipe string is run into a wellbore to a predetermined position. The drill pipe has a longitudinal bore for conducting fluids, for example, drilling fluids, lubrication fluids, and others. The drill pipe string can include a landing sub with a longitudinal bore disposed proximal to the lower end of the drill pipe string. For example, the landing sub can be part of a bottom hole assembly installed at the lower end of the drill pipe string. In some implementations, the step 610 may be represented in FIG. 1A, where the wellbore 150 has a substantially deviated section and the drill pipe string 114 is run into the wellbore 150.

At 615, a logging tool string is inserted into the upper end of the bore of the drill pipe string. The logging tool string may have a battery powered memory logging device. The logging tool string can be attached to a cable via a crossover tool. The cable may be used to lower the logging tool string into the wellbore at a desired velocity. In some implementations, the step 620 may be represented in FIG. 1B, where the logging tool string 200 is inserted into the pipe string 114 at the upper end near the surface 105. The logging tool string 200 can have a running tool 202 (as in FIG. 2A) and can be attached to the cable 111 via the crossover tool 211.

Figure 7:
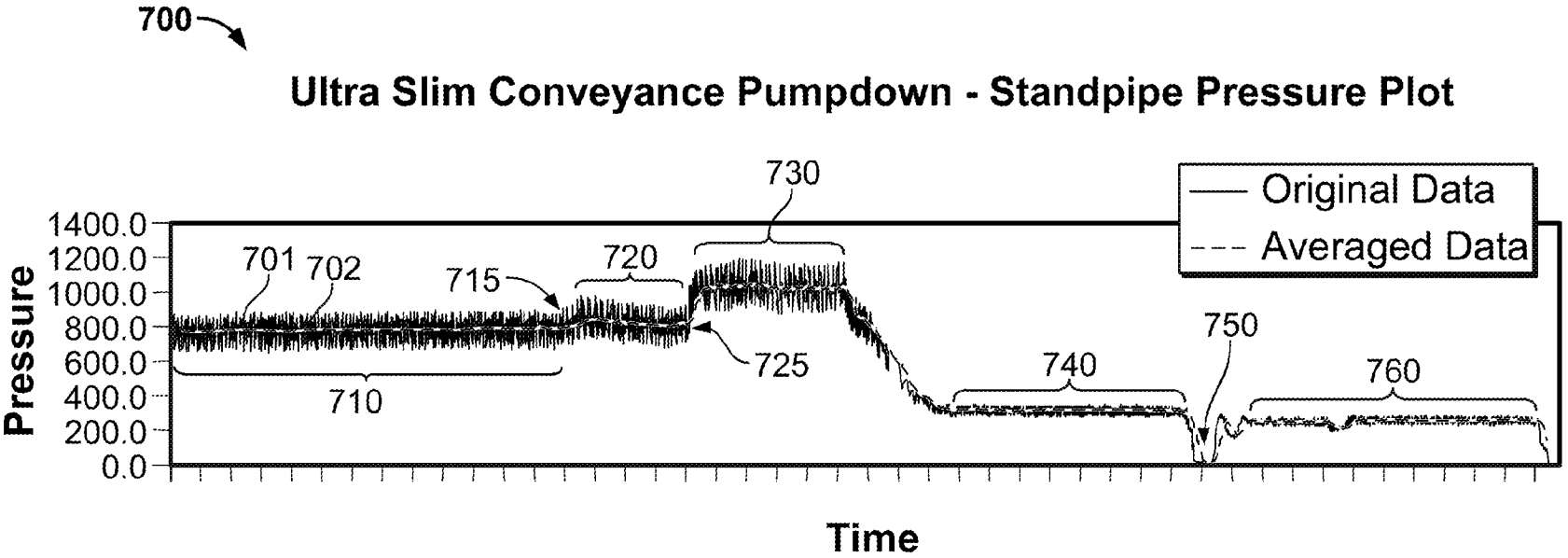
FIG. 7 is an example surface pressure profile for fluid used in the operation of the logging tool conveyance system of FIG. 1.

At 620, a fluid is pumped into the upper proximal end of the drill string bore above the logging tool string to assist movement of the tool string down the bore of the drill string. The fluid pressure can be applied onto the logging tool string to propel the downward movement of the tool string. The fluid pressure may also be monitored at the surface in real time to determine the status of the logging tool string at 625. For example, a pressure profile 700 is illustrated in FIG. 7, describing different stages of the movement of a logging tool string. Turning briefly to FIG. 7, the phase 710 represents a relatively constant pressure of the propelling fluid applied to the logging tool string at step 620. The propelling fluid pressure (with certain noise) is reflective of the speed that the tool is moving down the drill string bore and the rate at which fluid is being pumped through the drill string. The speed of movement is reflective of the speed at which the cable is spooled out at the surface as the fluid is pumped behind the tool string and the tool string is moving down the longitudinal bore of the drill pipe string at 630.

At 635, the tool string is landed in the landing sub of the drill pipe. At least a portion of the tool string that has logging tools (e.g., data logging instrument and equipment) is disposed below the bottom hole assembly 300 located on the distal end of the drill pipe string. For example, the landing procedure may be monitored in the change of the surface fluid pressure at 640, as illustrated in FIG. 7. Turning briefly to FIG. 7, an increase in pump pressure at 715 indicates that the tool string has entered the landing sleeve of the landing sub and the annular area between the outside of the tool string and the landing sub has been reduced resulting in a higher fluid pressure. For example, as illustrated in FIG. 3A, the tool string 200 has entered the landing sub 310 but has not yet landed. In FIG. 7, the pressure profile at section 720 is reflective of the tool body and its varying outside diameter passing through the varying inside diameter of the landing sub. The increase of pressure at 715 can be caused by a temporary reduction in cross section for fluid flow when the tool string enters the landing sub. But the fluid flow is not interrupted substantially as the tool string continues to move downwards.

At 725, however, a substantial increase of fluid pressure indicates that the tool string has landed onto the landing sub. This pressure increase can be due to the closing of available flow paths due to tool landing. For example, as illustrated in FIG. 3B, the nozzle 245 is inserted into the nozzle sub 312 and the shock sub 215 is pressed against the landing shoulder of the landing sleeve of the landing sub 310. However, fluid can continue to flow, though at a higher resistance, through a conduit in the nozzle 245 and the fluid by-pass 342, at an increased pressure. The increased pressure can be observed at 730 as the fluid is circulated through the by-pass. This observation at the surface of an increase in pressure at step 640 indicates to the operator that the downhole tool string has landed.

While the diagnostic is being run downhole, the operator pumps fluid at a lower rate. At step 643 the reed switches are activated when the switches are positioned opposite the magnets in the landing sub. The closing of the reed switch is sensed by the diagnostic module in the tool string and can be interpreted as a signal to run a self-diagnostic to determine if the logging tools are functioning properly.

At step 645, based on the confirmation by the diagnostic sequence run in the tool string that the tool string is operating properly, instructions are sent by the diagnostic module of the downhole tool to release the running tool from the tool string and displace the running tool 202 away from the upper end of the tool string. For example, as illustrated in FIG. 3C, the running tool is released as the spring release assembly 261 disengages with the fishing neck 263. The releasing procedure is also illustrated in FIG. 1D. The operator shuts down pumping while the running tool is being released.

At step 647 pumping is resumed at the rate established in step 643 and the surface pressure is observed to confirm that the running tool has been released. At step 649, pumping is stopped and sustained for a period of time for the crossover tool to be retrieved. This is illustrated in FIG. 7, where at 750 the fluid pressure drops and sustains at zero. For example, in FIG. 7, fluid pressure of section 760 is observed at surface while pumping through the tool string at 3 bbl/min. The pressure observed in section 760 is lower than the previously observed pressure in section 740, indicating the running tool has been displaced from the landing nozzle and the logging tool is properly seated in the landing sub and ready to obtain log data.

At 649 pumping is stopped and after the fluid pressure has been decreased to zero, at step 650 the cable is spooled in at the surface and the running tool is retrieved.

At 655, the drill pipe string is pulled upward in the wellbore, while log data is being recorded in the memory logging device as the data is obtained by the tool string passing by the geologic formations. For example, the data logging can include recording the radioactivity of the formation using a telemetry gamma ray tool, measuring formation density using a density neutron logging tool, detecting porosity using a borehole sonic array logging tool, recording resistivity using a compensated true resistivity tool array, and other information. After gathering and storing the log data as the logging device travels to the surface and the drill string is removed from the wellbore, the tool string is removed from the landing sub, the memory logging device is removed. The data in the memory device is then obtained and processed in a computer system at the surface. The data may be processed in the logging truck 115 at the well site or processed at locations remote from the well site.

FIG. 7 is the example pressure profile 700 for conveying logging tools, corresponding to the flow chart 600 illustrated in FIG. 6. The pressure profile 700 shows two data plots of fluid pressure (the y axis) versus time (the x axis). The first data set illustrated by trace 701 represents measured data at a high sampling rate. And the second data set illustrated by trace 702 represents averaged data points using every 20 measured data points. Therefore, the second data set provides a smoothed and averaged presentation of the surface pumping pressure.

Figure 8A:
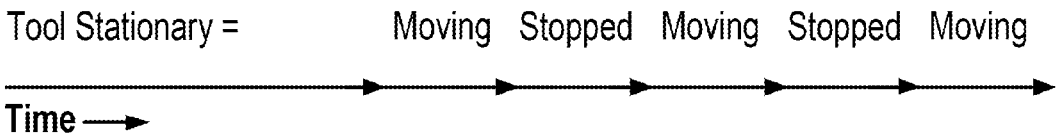
FIGS. 8A to 8C illustrate examples of signature signals that are created by moving the logging tool string in relation to the landing assembly of the drill string.
Figure 8B:
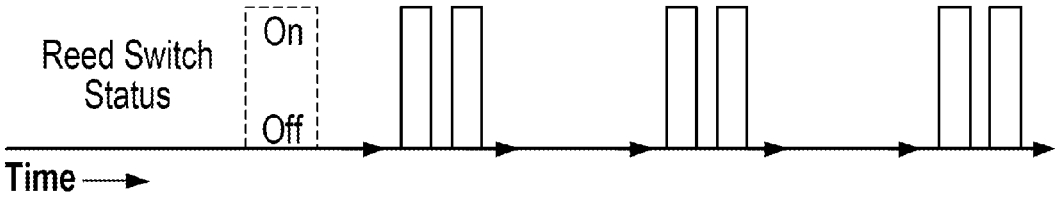
Figure 8C:
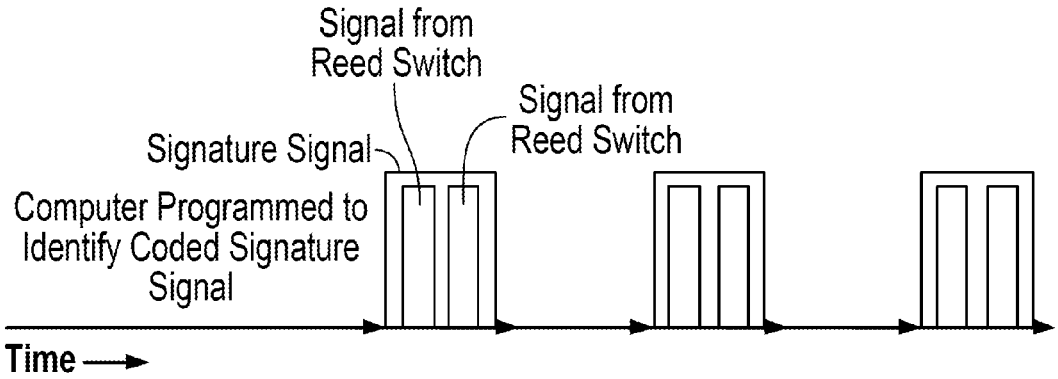

FIGS. 8A to 8C illustrate a method of communication from the surface to the downhole logging tool string via up and down movements of the drill string. The method includes movement of the drill string up or down at the surface to create coded signals by the downhole tool string and send those signature signals to a processor in the tool string that has been preprogramed to recognized the signature signals. In this method, small movements of the drill string at the surface cause the tool to be seated and is seated at controlled intervals in order to create coded signals to the downhole tool string. These signals are sent to a processor in the tool string that has been preprogrammed to recognize these as command signals. It will be understood that similar signal signatures can be created using reed switches (see FIG. 4A) and/or other position sensors including the sensors/switches illustrated in FIGS. 4B to 4E.

In one implementation of the communication method, the logging tool string is landed in the landing sub and is functioning as heretofore described. The logging tool string does not have any direct communication with the surface system. At least a portions of the logging tool string is deployed below the bottom hole assembly of the drill string and out into wellbore. The weight of the logging tool string in a horizontal portion of the well bore offers some degree of resistance to movement when the drill pipe is moved up and down. Moving the drill pipe up the well also moves the tool string up the well bore and forces the landing sleeve against the landing sub shoulder. This position also brings the magnetic field in close proximity of the reed switch which causes the reed switch to be actuated in the on position. If the drill pipe is moved down the well bore the logging tool string will remain stationary, due to the weight of the logging tool string and surface friction between the well bore wall and the exterior of the logging tool string. Because of surface friction between the lower portion of the tool extending out of the bottom hole assembly and the bore hole wall and the weight of the logging tool string in a horizontal borehole, the logging tool string may be stationary and the bottom hole assembly may be moved downward over and around the logging tool string (by design the tool string is free to move up into the drill pipe) while the landing sleeve moves away from the landing sub shoulder. This action moves the magnetic field farther away from the proximity of the reed switches causing the reed switches to be actuated in the off position. Therefore, the action of moving the drill pipe up and down actuates the opening and closing of the reed switches i.e. acting as a simple on/off switch and a signal will be sent to a processor in the tool string. Repeated raising and lowering of the drill string and movement of the bottom hole assembly relative to the reed switch in the tool string will send a signal pattern in a predetermined time window. The processor in the down hole tool string will be preprogrammed to look for the signal pattern in a predetermined time frame. When the signal pattern is recognized, the processor will match the pattern to a predetermined output signal to the logging tool string to begin or terminate an activity such as beginning obtaining and recording well log data and/or terminate log data gathering. Other signals may be sent to open or close the arms in a centralizer or hole caliper tool.

FIG. 8A represents a sequence of real time periods in which specified predetermined actions (e.g., raising and lowering the drill pipe in a specified time frame) will generate a coded signature signal. This coincides with predetermined time windows in which actions are to be performed and periods of no actions/movements.

FIG. 8B represents the up/down movements of the drill pipe used to activate the reed switches in the on and off position. The number of required on and off actions must be completed, in each of the real time period windows, as specified in FIG. 8A.

FIG. 8C represents the downhole processor in the tool string identifying a coded signature signal. The downhole processor will be programmed to recognize a pattern of accelerometer movements and/or reed switch signals which occur in a repeating time based pattern. Upon recognition of the coded signature signal the processor will tell the tool to respond to that command. For example, the processor will match the pattern to a predetermined output signal to the logging tool string to begin or terminate an activity such as beginning obtaining and recording well log data and/or terminate log data gathering. Other signals may be sent to open or close the arms in a centralizer or hole caliper tool.

A number of implementations have been described. Nevertheless, it will be understood that various modifications may be made. Further, the method 600 may include fewer steps than those illustrated or more steps than those illustrated. In addition, the illustrated steps of the method 600 may be performed in the respective orders illustrated or in different orders than that illustrated. As a specific example, the method 600 may be performed simultaneously (e.g., substantially or otherwise). Other variations in the order of steps are also possible. Accordingly, other implementations are within the scope of the following claims.

What is claimed is:

1. A method of obtaining well log data from a well bore comprising:

(a) running a drill pipe string having a longitudinal bore into a well bore to a predetermined position, said drill pipe string including a landing sub disposed proximal to a lower end of the drill pipe string;

(b) inserting a logging tool string into a proximal upper end of the longitudinal bore of the drill pipe string, said logging tool string comprising a running tool attached to a cable, a landing assembly and one or more logging tools;

(c) pumping a fluid into the upper proximal end of the longitudinal bore of the drill pipe string above the logging tool string to assist, via fluid pressure on the logging tool string, movement of the logging tool string down the longitudinal bore of the drill pipe string;

(d) spooling out the cable at the surface as the fluid is pumped behind the logging tool string and the logging tool string is moving down the longitudinal bore of the drill pipe string;

(e) observing the pump pressure at the surface during the pumping of the fluid;

(f) landing the landing assembly of the logging tool string in the landing sub of the drill pipe string, wherein at least a portion of the logging tool string including the one or more logging tools is disposed below a distal end of the drill pipe string;

(g) observing the pump pressure at the surface increase when the tool string is landed in the landing sub;

(h) determining by one or more devices in the logging tool string that the logging tool string is landed in the landing sub and sending one or more signals to one or more logging tools;

(i) activating and running by a diagnostic module located in the logging tool string a diagnostic test of the one or more logging tools to determine that the one or more logging tools are functioning properly;

(j) sending instructions by the diagnostic tool to a release mechanism located in the logging tool string to release the running tool portion of the tool string;

(k) observing a decrease in the pump pressure at the surface indicative of release of the running tool portion from a remaining portion of the logging tool string; and (l) spooling in the cable at the surface and retrieving the running tool portion.

2. The method of claim 1 further including pulling the drill pipe string upward in the well bore and recording data obtained by the one or more logging tools as the one or more logging tools is pulled upward by drill pipe string.

3. The method of claim 2 further including removing a memory logging device from the logging tool string and processing the recorded data in a computer system at the surface.

4. The method of claim 3 wherein removing the memory logging device from the drill pipe string includes lowering on a cable a fishing tool adapted to grasp a fishing neck on an upper end of the logging tool string disposed in the landing sub in the drill pipe, while the logging tool string and drill pipe string are still in the well bore.

5. The method of claim 3 wherein removing the memory logging device from the drill string includes removing the drill pipe string from the well bore and removing the logging tool string from the landing sub when the drill pipe is removed from the well bore.

6. The method of claim 1 further including:

activating a switch disposed in the logging tool string by positioning the switch in proximity to one or more magnets disposed in the landing sub of the drill pipe string and sending a signal to one or more logging tools that the logging tool string is in a landed position.

7. The method of claim 6 wherein the activated switch sends a signal to the logging tool string to run the diagnostic test of the logging tools to determine if they are functioning.

8. The method of claim 6 wherein activating a switch comprises closing a reed switch.

9. The method of claim 6 wherein activating a switch comprises positioning a giant magneto restrictive (GMR) sensor in a magnetic field generated by rare earth magnets disposed in the landing sub.

10. The method of claim 6 wherein activating a switch comprises positioning a hall effect sensor in a magnetic field generated by rare earth magnets disposed in the landing sub.

11. The method of claim 1 further including:

positioning a proximity detector in the logging tool string where in a coil emits a high frequency electromagnetic field and said detector in includes a threshold circuit that searches for a change in the field due to a nonferrous sleeve disposed in the landing sub and sending a signal to one or more logging tools that the logging tool string is in a landed position.

12. The method of claim 1 further including:

contacting the landing sub of the drill pipe string with a mechanical switch disposed in the logging tool string and sending a signal to one or more logging tools that the logging tool string is in a landed position.

13. An assembly for obtaining well log data from a wellbore comprising:

a bottom hole assembly adapted to be disposed on a distal end of a drill string, said bottom hole assembly comprising:

a landing sub having a bore therethrough with a landing shoulder in said bore sub; and a nozzle sub having a bore therethrough;

a tool string comprising:

a landing assembly including:

a running tool, said running tool including a crossover tool adapted on an upper end to connect to a cable;

a nozzle member having a profile adapted to be received in the bore of the nozzle sub;

a release assembly; and a landing device having an outer profile adapted to be received in the landing shoulder of the landing sub; and a logging assembly including:

at least one logging tool adapted to obtain data about at least one geologic formation penetrated by the wellbore;

a diagnostic module adapted to run a diagnostic sequence to determine if the at least one logging tool is functioning properly and send a signal to the release assembly;

a sensing device adapted to detect when the logging assembly is landed in the landing sub and send a signal to the diagnostic module.

14. The assembly of claim 13 wherein the signal sent by the sensing device further includes notifying the diagnostic module that the logging assembly is in proper position for logging and that the diagnostic module may begin the diagnostic sequence on the at least one logging tool.

15. The assembly of claim 13 further including:

a landing sleeve disposed in the bore of the landing sub wherein at least one magnet is disposed in the landing sleeve; and wherein the sensing device disposed in the tool string comprises a switch adapted to close when the switch in the tool string is proximal to the magnet in the landing sleeve.

16. The assembly of claim 15 wherein the switch comprises a reed switch.

17. The assembly of claim 15 wherein the switch comprises a GMR sensor.

18. The assembly of claim 15 wherein the switch comprises a Hall sensor.

19. The assembly of claim 14 further including a proximity detector disposed in the tool string said proximity detector emits a high frequency electromagnetic field and said detector further includes a threshold circuit that searches for a change in the electromagnetic field due to a nonferrous sleeve disposed in the landing sub and sending a signal to one or more logging tools that the tool string is in a landed position.

20. The assembly of claim 14 further including:

a landing sleeve disposed in the bore of the landing sub; and wherein the sensing device disposed in the tool string comprises a mechanical switch adapted to close when the switch in the tool string contacts the landing sleeve.

21. The assembly of claim 13 wherein the bottom hole assembly further includes a deployment sub disposed on a distal end of the bottom hole assembly, said deployment sub having a longitudinal bore therethrough, said deployment sub adapted to support the logging tool when the logging assembly is landing in the landing sub and the logging tool extends through the bore.

22. The assembly of claim 13 wherein the bottom hole assembly has a reamer disposed on a lower end of the bottom hole assembly, said reamer including a bore adapted for passage of the logging tool therethrough.

23. The assembly of claim 13 wherein the logging tool is configured to extend below the distal end of the bottom hole assembly when the logging assembly is landed in the landing sub.

24. The assembly of claim 13 wherein the logging assembly further includes a memory module to store data obtained by the at least one logging tool.

25. The assembly of claim 24 further including a battery disposed in the tool string for supplying power to the memory module.

26. The assembly of claim 13 wherein the landing device is a shock sub having an outer profile adapted to be received in the landing shoulder of the landing sub.

27. The assembly of claim 13 wherein the nozzle includes a flow conduit therethrough that is adapted to restrict fluid flow from the bore of the drill pipe string through the tool string and out into an annulus between the tool string and the bottom hole assembly.

28. A logging system for obtaining well log data from a wellbore comprising;

a drill string disposed in a well bore, said drill string having
- a longitudinal bore therethrough;
- a bottom hole assembly adapted to be disposed on a distal end of the drill string, said bottom hole assembly comprising:
  - a landing sub having a bore therethrough with a landing shoulder in said bore sub; and
  - a nozzle sub having a bore therethrough;
  - a cable adapted to be lowered inside the bore of the drill string and retrieved from the drill string;
- a tool string comprising:
  - a landing assembly including:
    - a running tool, said running tool including:
      - a crossover tool adapted on an upper end to connect to the cable;
      - a nozzle member having a profile adapted to be received in the bore of the nozzle sub;
      - a release assembly; and
      - a shock sub having an outer profile adapted to be received in the landing shoulder of the landing sub;

a logging assembly including:
- at least one logging tool adapted to obtain data about at least one geologic formation penetrated by the well bore;
- a memory module to store the data obtained by the at least one logging tool;
- a diagnostic module adapted to run a diagnostic sequence to determine if the at least one logging tool is functioning properly and send a signal to the release assembly; and
- a sensing device adapted to detect when the logging assembly is landed in the landing sub and send a signal to the diagnostic module; and a surface pump system adapted to pump fluid down the tool string behind the logging tool as it is lowered on the cable into the well and further adapted for observation of fluid pressure at the surface.

29. The system of claim 28 wherein the signal sent by the sensing device further includes notifying the diagnostic module that the logging assembly is properly positioned for logging and that the diagnostic module may begin the diagnostic sequence on the at least one logging tool.

30. The system of claim 28 further including:

a landing sleeve disposed in the bore of the landing sub wherein at least one magnet is disposed in the landing sleeve; and wherein the sensing device disposed in the tool string comprises a switch adapted to close when the switch in the tool string is proximal to the magnet in the landing sleeve.

31. The system of claim 30 wherein the switch comprises a reed switch.

32. The system of claim 30 wherein the switch comprises a GMR sensor.

33. The system of claim 30 wherein the switch comprises a Hall sensor.

34. The system of claim 28 further including a proximity detector disposed in the tool string said proximity detector emits a high frequency electromagnetic field and said detector further includes a threshold circuit that searches for a change in the electromagnetic filed due to a nonferrous sleeve disposed in the landing sub and sending a signal to one or more logging tools that the tool string is in a landed position.

35. The system of claim 28 further including:

a landing sleeve disposed in the bore of the landing sub; and wherein the sensing device disposed in the tool string comprises a mechanical switch adapted to close when the switch in the tool string contacts the landing sleeve.

36. The system of claim 28 wherein the bottom hole assembly further includes a deployment sub disposed on a distal end of the bottom hole assembly, said deployment sub having a longitudinal bore therethrough, said deployment sub adapted to support the logging tool when the logging assembly is landing in the landing sub and the logging tool extends through the bore.

37. The system of claim 28 wherein the bottom hole assembly has a reamer disposed on a lower end of the bottom hole assembly, said reamer including a bore adapted for passage of the logging tool therethrough.

38. The system of claim 28 wherein the logging tool is configured to extend below the distal end of the bottom hole assembly when the logging assembly is landed in the landing sub.

39. The system of claim 28 wherein the landing assembly is the shock sub having an outer profile adapted to be received in the landing shoulder of the landing sub.

40. The system of claim 28 wherein the logging assembly further includes a memory module to store data obtained by the at least one logging tool.

41. The system of claim 40 further including a battery disposed in the tool string for supplying power to the memory module.

42. The system of claim 28 wherein the nozzle includes a flow conduit therethrough that is adapted to allow fluid flow from the longitudinal bore of the drill string through the tool string and a fluid bypass disposed in the landing sub.

* * * * *

UNITED STATES PATENT AND TRADEMARK OFFICE

CERTIFICATE OF CORRECTION

PATENT NO. : 8,875,808 B2
APPLICATION NO. : 14/240522
DATED : November 4, 2014
INVENTOR(S) : Ronald Eugene Cherry, Andrew Albert Hrametz and Nathan James Harder It is certified that error appears in the above-identified patent and that said Letters Patent is hereby corrected as shown below:

In the Claims

Claim 1, Column 14, Line 44, replace “well bore” with -- wellbore --

Claim 1, Column 14, Line 47, replace “well bore” with -- wellbore --

Claim 2, Column 15, Line 24, replace “well bore” with -- wellbore --

Claim 4, Column 15, Line 36, replace “well bore” with -- wellbore --

Claim 5, Column 15, Line 39, replace “well bore” with -- wellbore --

Claim 5, Column 15, Line 41, replace “well bore” with -- wellbore --

Claim 28, Column 17, Line 32, replace “well bore” with -- wellbore --

Claim 28, Column 17, Line 55, replace “well bore” with -- wellbore --

Claim 28, Column 18, Line 3, replace “well” with -- wellbore --

Signed and Sealed this
Twenty-fourth Day of February, 2015

Michelle K. Lee

Michelle K. Lee
*Deputy Director of the United States Patent and Trademark Office*